US005569577A

United States Patent [19]

Hasebe

[11] Patent Number: 5,569,577

[45] Date of Patent: Oct. 29, 1996

[54] SILVER HALIDE COLOR PHOTOGRAPHIC MATERIAL

[75] Inventor: Kazunori Hasebe, Minami-ashigara, Japan

[73] Assignee: Fuji Photo Film Co., Ltd., Kanagawa, Japan

[21] Appl. No.: 400,573

[22] Filed: Mar. 8, 1995

[30] Foreign Application Priority Data

Mar. 8, 1994 [JP] Japan ..... 6-37087
May 6, 1994 [JP] Japan ..... 6-117613

[51] Int. Cl.[6] ..... G03C 1/76

[52] U.S. Cl. ..... 430/523; 430/531; 430/533; 430/538; 430/567; 430/599; 430/600; 430/607; 430/611; 430/613; 430/517; 430/522; 430/558

[58] Field of Search ..... 430/503, 523, 430/531, 533, 538, 567, 599, 600, 607, 611, 613, 517, 522, 558

[56] References Cited

U.S. PATENT DOCUMENTS 5,391,471 2/1995 Ohshima et al. ..... 430/611
5,429,916 7/1995 Ohshima ..... 430/538

FOREIGN PATENT DOCUMENTS 4256948 9/1992 Japan .

*Primary Examiner*—Geraldine Letscher
*Attorney, Agent, or Firm*—Sughrue, Mion, Zinn, Macpeak & Seas

[57] ABSTRACT

Disclosed is a color photographic material having, on a reflective support coated with waterproof resin layers, at least three different color-sensitive silver halide emulsion layers containing any of cyan, magenta and yellow couplers, in which the number of said waterproof resin layers under said photographic constitutive layers is at least three, at least one of said waterproof resin layers contains from 15% by weight to 45% by weight of a white pigment, the waterproof resin layer nearest to the substrate of the support and that nearest to the photographic constitutive layers donor contain a white pigment or contain it in an amount of 20% by weight or less, the thickness of the waterproof resin layer nearest to the photographic constitutive layers is 5 μm or less, and at least one emulsion layer contains high silver chloride emulsion grains having a silver chloride content of 95 mol % or more and contains a mercaptohetercyclic compound. The photographic material can be processed rapidly to form a color image having high sharpness while having high whiteness in the background area. The material has high folding resistance, and the density of the image at the folded part is not lowered. Even when the material is cut with a dull cutter, the edges of the resulting pieces are not rough. The edges of the pieces are not colored by development.

12 Claims, No Drawings

SILVER HALIDE COLOR PHOTOGRAPHIC MATERIAL

FIELD OF THE INVENTION

The present invention relates to a silver halide color photographic material, especially to a reflective color photographic material which has a high sensitivity and can be processed rapidly to give a color print having a high degree of whiteness and a high sharpness.

BACKGROUND OF THE INVENTION

A color photographic picture is a color image to be obtained by developing a photographic material having, on a support, photographic constitutive layers containing dye-forming couplers (hereinafter referred to as couplers) and silver halide emulsions, with an aromatic primary amine color developing agent, in which the couplers are reacted with the oxidation product of the developing agent to form dyes.

It is extremely required in the color photographic industry to simplify and rapidly process the color development to form color images, and various improvements have heretofore been made according to this requirement to develop new, more simple and rapid systems.

To rapidly process color photographic materials, it is preferred that the materials have high silver chloride emulsions.

On the other hand, in order to obtain color photographic images of a high quality, it is needed to elevate the sharpness of the images. For this, various methods have heretofore been proposed.

For instance, water-soluble dyes are generally added to photographic materials. This technology is described in, for example, JP-A 62-283336 (the term "JP-A" as used herein means an "unexamined published Japanese patent application"), Research Disclosure RD-17643 (December 1978, page 22), RD-18716 (November 1979, page 647).

JP-A 63-286849 discloses a method of providing an anti-halation layer containing a colorant that can be decolored by development, such as a colloidal silver or a solid dye dispersion, in a color photographic material so as to elevate the sharpness of the color image to be formed in the material.

However, if water-soluble dyes and anti-halation layers are applied to the above-mentioned photographic materials that have high silver chloride emulsions from the preferred viewpoint for their rapid processing and if the content of the colorants or dyes added are increased to such a degree that is necessary for satisfactorily elevating the sharpness of the color images to be formed, the sensitivity of the photographic materials is lowered and the degree of whiteness of the processed photographic materials is lowered. Because of these problems, it was impossible to obtain high silver chloride photographic materials capable of giving color images having a sufficient degree of sharpness.

Referring to another means for elevating the sharpness of a color photographic image, it is described in JP-A 3-156452 to increase the content of a white pigment to be in the waterproof resin layer constituting the support of a photographic material. Unexpectedly, however, it has been found that, when this means is applied to the above-mentioned photographic materials that have high silver chloride emulsions from the preferred viewpoint for their rapid processing and when the photographic materials and the developed prints, to which this means has been applied, are cut with a dull cutter, the edges of the thus-cut pieces cannot be sharp but are rough while releasing considerable wastes. In addition to this drawback, it has also been found that the edges of the thus-cut pieces become yellowed after development. As still another problem, the color density of the developed photographic materials is lowered when they are folded.

As mentioned above, the conventional means that have heretofore been proposed for obtaining photographic materials which have a high sensitivity and a high degree of sharpness and which can be processed rapidly are all unsatisfactory. Therefore, it is desired to develop novel techniques capable of satisfying the current requirements in the color photographic industry.

SUMMARY OF THE INVENTION

The present invention has been made in consideration of the above-mentioned problems in the prior art, and its object is to provide, at low costs, a reflective color photographic material which has a high sensitivity and which can be processed rapidly to give a color print having a high degree of whiteness and a high degree of sharpness.

More precisely, the object of the present invention is to overcome the problems with the conventional photographic materials which have a support having waterproof resin layers and having an elevated content of a white pigment in the layer and which have high silver chloride emulsions. As mentioned above, the problems with the conventional photographic materials are such that the degree of whiteness of the color prints to be obtained by processing the materials is low, that when the materials are cut with a dull cutter, the edges of the cut pieces are rough, that the edges of the cut pieces become yellow after development and that the color density of the developed photographic materials is lowered at the folded parts. Accordingly, the object of the present invention is to provide, at a low costs, a reflective color photographic material which has a high sensitivity and which can be processed rapidly to give a color print having a high degree of whiteness and a high degree of sharpness.

We, the present inventors have assiduously studied and have found that the above-mentioned object of the present invention can be attained effectively by a silver halide color photographic material having, on a reflective support composed of a substrate coated with waterproof resin layers, photographic constitutive layers comprising at least a silver halide emulsion layer containing cyan dye-forming coupler(s), a silver halide emulsion layer containing magenta dye-forming coupler(s), a silver halide emulsion layer containing yellow dye-forming coupler(s) and plural non-light-sensitive colloidal layers, which is characterized in that the number of said waterproof resin layers under said photographic constitutive layers is at least three, at least one of said waterproof resin layers contains from 15% by weight to 45% by weight of a white pigment, the waterproof resin layer nearest to the substrate and that nearest to the photographic constitutive layers do not contain a white pigment or contain it in an amount of 20% by weight or less, the thickness of the waterproof resin layer nearest to the photographic constitutive layers is 5 μm or less, at least one silver halide emulsion to be contained in at least one of said silver halide emulsion layers contains high silver chloride emulsion grains having a silver chloride content of 95 mol % or more, and the layer containing the high silver chloride emulsion contains a compound of a general formula (1):

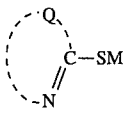

(1)

wherein Q represents an atomic group necessary for forming a 5-membered or 6-membered hetero ring or a 5-membered or 6-membered hereto ring condensed with benzene ring(s); and M represents a cation.

As one preferred embodiment of the silver halide color photographic material of the present invention mentioned above, at least one of said three or more waterproof resin layers of the support under the photographic constitutive layers contains a colorant in such a way that the waterproof resin layer nearer to the substrate of the support than the waterproof resin layer having the highest content of the white pigment has the highest content of the colorant.

As another preferred embodiment of the silver halide color photographic material of the present invention mentioned above, at least one of the magenta dye-forming coupler(s) is a compound represented by the following formula (M-1):

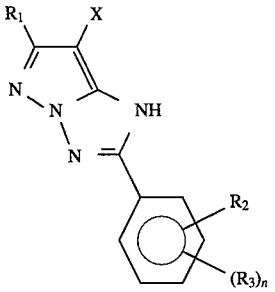

(M-1)

wherein $R_1$ represents a group represented by the following formula (Q-1), (Q-2) or (Q-3); $R_2$ and $R_3$ each represent a substitutent; n represents an integer of 0 to 4; X represents a hydrogen atom, or a group capable of being released by a coupling reaction with an oxidation product of a developing agent:

$$—C(R_4)(R_5)—(R_6) \quad (Q\text{-}1)$$

wherein, $R_4$ represents an alkyl group, a cycloalkyl group, an aryl group or a heterocyclic group, $R_5$ and $R_6$ each represent a substituent, and at least two of $R_4$, $R_5$ and $R_6$ may be connected to form a 5- to 7-membered monocyclic or condensed ring;

$$—CH(R_7)—(R_8) \quad (Q\text{-}2)$$

wherein, $R_7$ represents an alkyl group, a cycloalkyl group, an aryl group or a heterocyclic group, $R_8$ represents a substituent, and $R_7$ and $R_8$ may be connected to form a 5- to 7-membered monocyclic or condensed ring;

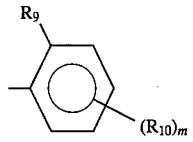

(Q-3)

wherein, $R_9$ and $R_{10}$ each represent a substituent, m represents an integer of 0 to 4, and when m is 2 or more, two or more of $R_{10}$ may be the same or different.

DETAILED DESCRIPTION OF THE INVENTION

The present invention will be described in more detail hereunder.

In the photographic material of the present invention, it is indispensable that the number of the waterproof resin layers of the reflective support under the photographic constitutive layers is three or more.

The content of a white pigment in the waterproof resin layer having the highest content of a white pigment is from 15% by weight to 45% by weight, preferably from 15% by weight to 40% by weight, more preferably from 20% by weight to 40% by weight. If the content of a white pigment in this layer having the highest white pigment content is less than 15% by weight, the sharpness of the image to be formed will be low; but if it is more than 45% by weight, the laminated film to be formed by melt extrusion will be cleaved. Such are unfavorable.

Of these waterproof resin layers, the layer nearest to the substrate of the support and that nearest to the photographic constitutive layers do not contain a white pigment or contain it in an amount of 20% by weight or less, whilst the above-mentioned layer having the highest content of a white pigment must be positioned between these layers having a relatively lower content of a white pigment.

The total content of the white pigment to be in all these waterproof resin layers is preferably from 1 $g/m^2$ to 15 $g/m^2$, more preferably from 2 $g/m^2$ to 10 $g/m^2$, even more preferably from 4 $g/m^2$ to 8$g/m^2$.

As examples of the waterproof resin to be used for producing the reflective support for use in the present invention, mentioned are polyolefins such as polyethylene, polypropylene, polyethylenic polymers, etc. Of these, especially preferred is polyethylene which includes, for example, high-density polyethylene, low-density polyethylene, linear low-density polyethylene and their mixtures. It is preferred that these polyolefin resins for the use in the present invention have, before being processed, a melt flow rate (hereinafter referred to as MFR) of from 1.2 g/10 min to 12 g/10 min in terms of the value measured under Condition 4 in Table 1 in JISK 7210. MFR of the non-processed polyolefin resins as referred to herein indicates either MFR of the resins not containing the colorant and the white pigment to be added thereto or MFR of the diluted resins before being coated on the substrate of the support.

As examples of the white pigment to be added to and dispersed in the waterproof resin that is coated on the substrate of the reflective support of the present invention, mentioned are inorganic pigments such as titanium dioxide, barium sulfate, lithopone, aluminium oxide, calcium carbonate, silicon oxide, antimony trioxide, titanium phosphate, zinc oxide, white lead, zirconium oxide, etc., and organic fine powders of polystyrene, styrene-divinylbenzene copolymer, etc.

Of these pigments, titanium dioxide is especially effective. As titanium dioxide, usable is either rutile-type or anatase-type one. However, if the photographic material is intended to preferentially have a high level of whiteness, anatase-type titanium dioxide is preferred, but if it is intended to preferentially have a high level of sharpness, rutile-type titanium dioxide is preferred. Considering both the whiteness and the sharpness, a blend comprising anatase-type titanium dioxide and rutile-type titanium dioxide may be used. It is also preferred to incorporate anatase-type titanium dioxide into one or more of the waterproof resin coat layers constituting the multi-layer support while incorporating rutile-type titanium dioxide into the other(s) of them. Titanium dioxide of these types may be produced by any of a sulfate method and a chloride method. As commercial products of such titanium dioxide, mentioned are KA-10 and KA-20 of Titanium Industrial Co., A-220 of Ishihara Sangyo KK, etc.

The surfaces of titanium dioxide grains to be used in the present invention may be processed with inorganic substances such as aluminium hydroxide, silicon hydroxide, etc., or organic substances such as polyalcohols, polyamines, metallic soap, alkyl titanates, polysiloxanes, etc., or mixtures of such inorganic and organic substances, so as to retard the activity of titanium dioxide and to prevent it from yellowing. The amount of the surface-treating agent to be applied to titanium dioxide is preferably from 0.2% by weight to 2.0% by weight for the inorganic substances and from 0.1% by weight to 1.0% by weight for the organic substances.

The mean grain size of titanium dioxide grains to be used in the present invention is preferably from 0.1 to 0.8 μm. If it is less than 0.1 μm, the grains are difficult to uniformly mix and disperse in resins and therefor such fine grains are unfavorable. If, however, it is more than 0.8 μm, the photographic material cannot have a sufficient degree of whiteness and, in addition, such large grains will make small hills on the coated surface to have a bad influence on the image quality of images to be formed.

To mix a waterproof resin and a white pigment so as to prepare the white pigment-containing waterproof resin coat layers of the reflective support of the present invention, the pigment is kneaded into the resin using a mixing and kneading device such as a two-roll or three-roll kneader, a Bumbury's mixer, etc. and using a dispersing aid chosen from among metal salts of higher fatty acids, esters of higher fatty acids, higher fatty acid amides, higher fatty acids, etc. and formed into a master batch comprising pellets. The white pigment content in these pellets is, in general, approximately from 30% by weight to 75% by weight; and the dispersing aid is, in general, approximately from 0.5% by weight to 10% by weight, relative to the white pigment.

The waterproof resin layers preferably contain a colorant in order to more improve the sharpness and other properties of the photographic material of the present invention. The colorant is not specifically defined, provided that it may absorb visible rays in the resin layers. As examples of the colorant, mentioned are ultramarine, cobalt blue, cobalt phosphate oxide, quinacridone pigments, etc., and their mixtures. Where the colorant is added to the layers as its solid dispersion, the grain size of the grains of the dispersion is not specifically defined. The grain size of the grains of commercial colorants is, in general, approximately from 0.3 μm to 10 μm, which is employable in the present invention with no problem.

The colorant is kneaded into a waterproof resin, using a mixing and kneading device such as a two-roll or three-roll kneader, a Bumbury's mixer, etc. and shaped into pellets to be a master batch. The content of the colorant in the pellets may be from 1% by weight to 30 % by weight. Preparing the pellets containing the colorant, a white pigment may be kneaded thereinto along with this. If desired, a dispersing agent chosen from among low molecular weight-waterproof resins, metal salts of higher fatty acids, esters of higher fatty acids, higher fatty acid amides, higher fatty acids, etc. may be used so as to promote the dispersion of the colorant.

The content of the colorant is preferably from 0 to 8.0% by weight, more preferably from 0.1 to 5% by weight, relative to the total resin content in all the waterproof resin layers below the photographic constitutive layers.

It is recommended that a larger amount of the colorant is added to the waterproof resin layer positioned nearer to the substrate of the support than the waterproof resin layer having the highest content of a white pigment. In this case, the amount of the colorant to be in at least one waterproof resin layer nearer to the substrate of the support is preferably from 0 to 20% by weight, more preferably from 1 to 15% by weight.

The waterproof resin layers may contain an antioxidant. The content of the antioxidant is suitably from 50 to 1000 ppm, relative to the waterproof resin.

The thus-formed master batch containing a white pigment and/or a colorant is suitably diluted with a waterproof resin before use.

To coat the plural waterproof resin coat layers on a substrate to prepare the reflective support for use in the present invention, employable is any of a successive lamination method where the above-mentioned pellets containing a white pigment and/or a colorant are melted under heat, then optionally diluted with a heat-resistant resin and laminated successively on a running substrate, such as paper or a synthetic paper, or a co-extruding lamination method where the melts are simultaneously laminated on a running substrate through a feed-block-type, multi-manifold-type or multi-slot-type multi-layer extrusion die. The multi-layer extrusion die is generally a T-die, a coat hunger die, etc. and is not specifically defined. The temperature of the melts of the waterproof resins to be extruded is generally from 280° C. to 340° C., especially preferably from 310° C. to 330° C., at the outlet of the die. Before coating the substrate with the resins, the substrate is preferably activated by corona discharging, flame treatment, glow discharging, etc.

The total thickness of the plural white pigment-containing, waterproof resin coat layers to be formed on the substrate of the reflective support for use in the present invention is preferably from 5 to 100 μm, more preferably from 5 to 80 μm, especially preferably from 10 to 50 μm. If it is more than 100 μm, the properties of the layers will be problematic in that the layers are cracked due to the brittleness of the resin. If, however, it is less than 5 μm, the water-proofness which is the intrinsic object of the coating will be lost and, in addition, it is impossible to satisfy both the whiteness and the surface smoothness at the same time, and the layers will be unfavorably too soft in view of their physical properties.

The thickness of each of the plural waterproof resin coat layers is referred to. When the support has three waterproof resin coat layers, it is preferred that the thickness of the uppermost layer is from 0.2 μm to 5 μm, that of the interlayer is from 5 μm to 50 μm, and that of the lowermost layer (nearest to the substrate of the support) is from 0.5 μm to 30 μm. If the thickness of the uppermost layer and that of the lowermost layer each are less than 0.2 μm and less than 0.5 μm, respectively, die lip streaks will be formed on the coated surface due to the action of the highly-densified white pigment in the interlayer. On the other hand, however, if the thickness of the uppermost layer and the lowermost layer, especially that of the uppermost layer is more than 5 μm, the sharpness of the photographic material will be lowered.

The thickness of the resin or resin composition layer coated on the surface of the substrate of the support which is not coated with the photographic constitutive layers is preferably from 5 to 100 μm, more preferably from 10 to 50 μm. If it is more than the range, the properties of the layer will be problematic in that the layer is cracked due to the brittleness of the resin. If, however, it is less than the range, the water-proofness which is the intrinsic object of the coating will be lost and, in addition, and the layer will be unfavorably too soft in view of its physical properties.

The surface of the uppermost waterproof resin coat layer on which the photographic constitutive layers are provided is made glossy, or is made fine in such a way as in JP-A 55-26507, or is shaped to be a matt or silky surface, while the back surface thereof is shaped to be non-glossy. After thus-shaped, the surface of the support may be activated by corona discharging, flame treatment, etc. In addition, after the activation, the support may be coated with subbing layer(s) in such a way as in JP-A 61-84643.

The substrate of the reflective support for use in the present invention may be any of a natural pulp paper made of natural pulp as the essential raw material, a mixed paper composed of natural pulp and synthetic fibers, a synthetic fiber paper consisting essentially of synthetic fibers, and a so-called synthetic paper made of synthetic resin films such as polystyrene, polypropylene, etc. by papermaking. As the waterproof resin-coated paper base for the support of the photographic printing papers of the present invention, a natural pulp paper (hereinafter referred to as a base paper) is especially advantageously used.

The thickness of the substrate of the support for use in the present invention is not specifically defined, but the weight thereof is desirably from 50 g/m$^2$ to 250 g/m$^2$ and the thickness thereof is desirably from 50 μm to 250 μm.

The support for use in the present invention may be coated with various backing layers so as to prevent it from being electrically charged and from being curled. Such backing layers may contain an inorganic antistatic agent, an organic antistatic agent, a hydrophilic binder, a latex, a hardening agent, pigments, surfactants, etc., as combined suitably, such as those described or illustrated in JP-B 52-18020, 57-9059, 57-53940, 58-56859, and JP-A 59-214849, 58-184144. (The term "JP-B" as used herein means an "examined Japanese patent publication".)

As the support for the photographic printing papers of the present invention, especially preferred is one having high smoothness on its surface to be coated with the photographic constitutive layers. The "smoothness" is presented by the surface roughness of the support as the criterion for the smoothness.

The surface roughness of the support for use in the present invention is referred to. To indicate the surface roughness, employed is a degree of surface roughness at the center line of the support as the criterion. The degree of surface roughness at the center line of the support is defined as follows: A part having an area of SM is cut out of the support having a curved rough surface, relative to its center face, rectangular coordinates composed of X-axis and Y-axis are drawn relative to the center line of the thus-cut part while the axis that cuts the center line at right angles is drawn as Z-axis, and the value (μm) to be represented by the following equation is defined as the intended mean surface roughness at the center line (SRa).

$$SRa = \frac{1}{SM} \int_0^{L_X} \int_0^{L_Y} |f(X, Y)| dX dY$$

where $L_X L_Y = SM$ $Z = f(X,Y)$

The mean surface roughness at the center line and the height of the projections from the center line can be obtained, using, for example, a three-dimensional surface roughness metering device (SE-30H Model, produced by Kosaka Laboratories Co.). Briefly, a part of the support having an area of 5 mm$^2$ is measured with this device, using a diamond needle having a diameter of 4 μm, at a cut-off value of 0.8 mm and at 20 magnifications in the horizontal direction and 2000 magnifications in the vertical direction. The feeding speed of the needle is preferably about 0.5 mm/sec.

It is desirable to use the support having the value of 0.15 μm or less, preferably 0.10 μm or less, to be obtained by this measurement. Using the support having a degree of surface roughness (indicating the surface smoothness) falling within this range, color prints having good surface smoothness can be obtained.

The non-developed photographic material of the present invention is defined to have an optical reflective density of 0.2 or more, preferably from 0.3 to 2.0, more preferably from 0.5 to 1.5, even more preferably from 0.8 to 1.5, at a wavelength of 550 nm.

At a wavelength of 680 nm, the material has an optical reflective density of 0.3 or more, preferably from 0.5 to 2.0, more preferably from 0.7 to 1.5, even more preferably from 1.0 to 1.5.

At a wavelength of 480 nm, the material preferably has an optical reflective density of from 0.2 to 2.0, more preferably from 0.3 to 1.5, even more preferably from 0.4 to 1.5.

It is desirable that the above-mentioned reflective density is attained by adding a water-soluble dye of the following general formula (2) to any of the photographic constitutive layers coated on the support. Specific examples of dyes of formula (2) are mentioned in the following Tables 1 to 6 as their substituents, which, however, are not intended to restrict the scope of the present invention.

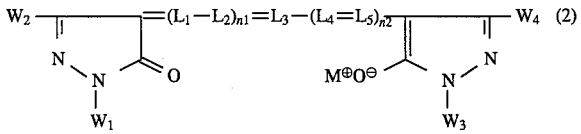

wherein $W_1$ and $W_3$ each represent an aliphatic group, an aromatic group or a heterocyclic group;

$W_2$ and $W_4$ each represent an aliphatic group, an aromatic group, —$OW_5$, —$COOW_5$, —$NW_5W_6$, —$CONW_5W_6$, —$NW_5CONW_6$, —$SO_2W_7$, —$COW_7$, —$NW_6COW_7$, —$NW_6SO_2W_7$, or a cyano group;

$W_5$ and $W_6$ each represent a hydrogen atom, an aliphatic group or an aromatic group; $W_7$ represents a hydrogen atom or an aliphatic group; $W_5$ and $W_6$, or $W_6$ and $W_7$ may be bonded to each other to form a 5-membered or 6-membered ring;

$L_1$, $L_2$, $L_3$, $L_4$ and $L_5$ each represent a methine group;

$n_1$ and $n_2$ each represent 0 or 1; and $M^+$ represents a hydrogen atom or a monovalent cation.

The aliphatic group obtained in $W_1$, $W_2$, $W_3$, $W_4$, $W_5$, $W_6$ and $W_7$ includes an alkyl group, a cycloalkyl group and an alkenyl group.

Of these dyes, preferred are those where $W_1$ and $W_3$ each are an aliphatic group (more preferably an unsubstituted lower alkyl group, even more preferably methyl group). Also preferably, $W_2$ and $W_4$ each are a saturated heterocyclic carbonyl group to be represented by —$CONW_5W_6$ where $W_5$ and $W_6$ are bonded to each other to form a 5-membered or 6-membered ring, more ring, more preferably a morpholinocarbonyl group.

Examples of such low-molecular oxonole dyes are described in Japanese Patent Application No. 5-306814.

| | $W_1$, $W_3$ | $W_2$, $W_4$ | $=(L_1-L_2)_{n1}=L_3-(L_4=L_5)_{n2}-$ | $M^{\oplus}$ |
|---|---|---|---|---|
| III-1 | 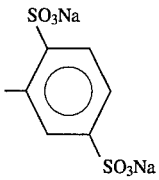 | $-CH_3$ | $=CH-$ | H |
| III-2 | 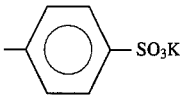 | $-CONHC_3H_7^{(n)}$ | $=CH-$ | H |
| III-3 | 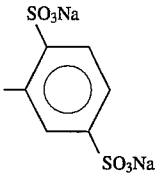 | $-OH$ | $=CH-CH=CH-$ | Na |
| III-4 | 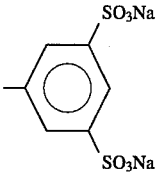 | $-OC_2H_5$ | $=CH\text{-}(CH=CH)_2\text{-}$ | Na |
| III-5 | $-CH_2CH_2SO_3K$ | $-COOC_2H_5$ | $=CH-CH=CH-$ | H |
| III-6 | 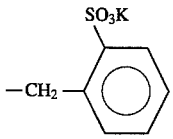 | $-CONHC_4H_9^{(n)}$ | $=CH-CH=CH-$ | H |
| III-7 | $-CH_2CH_2SO_3K$ | $-COOK$ | $=CH\text{-}(CH=CH)_2\text{-}$ | H |
| III-8 | 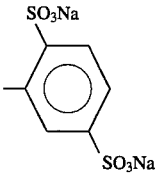 | $-COCH_3$ | $=CH\text{-}(CH=CH)_2\text{-}$ | Na |
| III-9 | 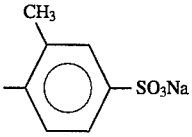 | $-CF_3$ | $=CH\text{-}(CH=CH)_2\text{-}$ | H |
| III-10 | 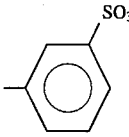 | $-NHCOCH_3$ | $=CH-CH=CH-$ | H |
| III-11 | 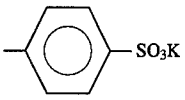 | $-COOC_2H_5$ | $=CH\text{-}(CH=CH)_2\text{-}$ | H |

-continued

| | $W_1$, $W_3$ | $W_2$, $W_4$ | $=(L_1-L_2)_{n1}=L_3-(L_4=L_5)_{n2}-$ | $M^{\oplus}$ |
|---|---|---|---|---|
| III-12 | 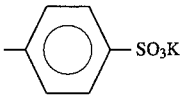 | $-COOK$ | $=CH-CH=CH-$ | H |
| III-13 | 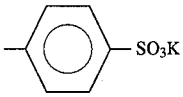 | $-NHCONHCH_3$ | $=CH-CH=CH-$ | H |
| III-14 | $-(CH_2)_4SO_3K$ | $-OH$ | $=CH-$ | H |
| III-15 | 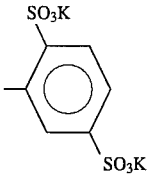 | $-COOK$ | $=CH-CH=CH-$ | K |
| III-16 | 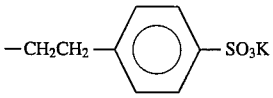 | $-C_6H_5$ | $=CH-CH=CH-$ | H |
| III-17 | 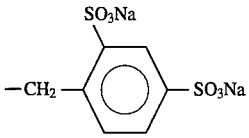 | $-COOC_2H_5$ | $=CH-(CH=CH)_2-$ | Na |
| III-18 | 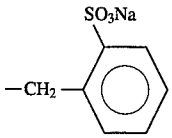 | $-CONHCH_2CH_2OH$ | $=CH-(CH=CH)_2-$ | H |
| III-19 | 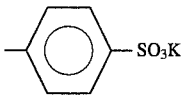 | $-CONHCH_2CH_2SO_3K$ | $=CH-(CH=CH)_2-$ | H |
| III-20 | $-(CH_2)_3SO_3K$ | $-CONHC_7H_{15}^{(n)}$ | $=CH-CH=CH-$ | H |
| III-21 | $-CH_2COOK$ | $-COOK$ | $=CH-CH=CH-$ | K |
| III-22 | $-CH_2CH_2SO_3K$ | $-N(CH_3)_2$ | $=CH-(CH=CH)_2-$ | H |
| III-23 | $-(CH_2)_3SO_3K$ | $-CN$ | $=CH-(CH=CH)_2-$ | H |
| III-24 | 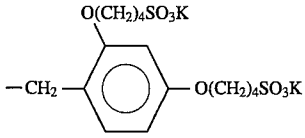 | $-CH_2Cl$ | $=CH-(CH=CH)_2-$ | H |
| III-25 | $-(CH_2)_2SO_3Na$ | $-OH$ | $=CH-(CH=CH)_2-$ | H |
| III-26 | 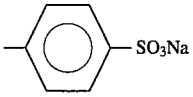 | $-CH_3$ | $=CH-C(CH_3)=CH-$ | Na |
| III-27 | 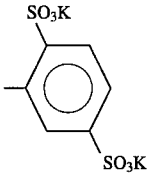 | $-COOC_2H_5$ | $=CH-(CH=CH)_2-$ | H |

-continued
| | $W_1$, $W_3$ | $W_2$, $W_4$ | $=(L_1-L_2)_{n1}=L_3-(L_4=L_5)_{n2}-$ | $M^{\oplus}$ |
|---|---|---|---|---|
| III-28 | 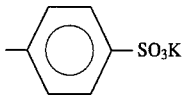 | $-CONHC_2H_5$ | $=CH-CH=CH-$ | H |
| III-29 | 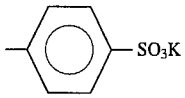 | $-NHCOC_3H_7^{(t)}$ | $=CH-CH=CH-$ | H |
| III-30 | $-CH_2CH_2SO_3K$ | 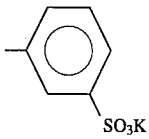 | $=CH-CH=CH-$ | H |
| III-31 | 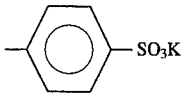 | $-CH_3$ | $=CH-$ | H |
| III-32 | 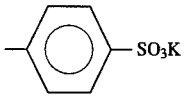 | $-{}^{t}C_4H_9$ | $=CH-CH=CH-$ | H |
| III-33 | 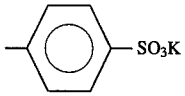 | $-CN$ | $=CH(CH=CH)_2-$ | H |
| III-34 | 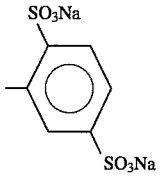 | $-COCH_3$ | $=CH-$ | H |
| III-35 | 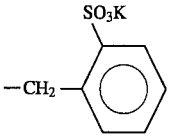 | $-COOK$ | $=CH(CH=CH)_2-$ | H |
| III-36 | 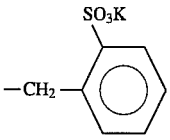 | $-COOK$ | $=CH-CH=CH-$ | H |
| III-37 | 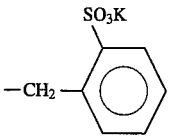 | $-CONHC_4H_9^{(t)}$ | $=CH(CH=CH)_2-$ | H |
| III-38 | 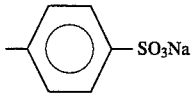 | $-NHSO_2CH_3$ | $=CH(CH=CH)_2-$ | H |

-continued

| | $W_1$, $W_3$ | $W_2$, $W_4$ | $=(L_1-L_2)_{n1}=L_3-(L_4=L_5)_{n2}-$ | $M^{\oplus}$ |
|---|---|---|---|---|
| III-39 | 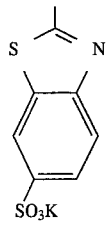 | $-CN$ | $=CH-(CH=CH)_2-$ | H |
| III-40 | 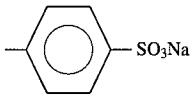 | $-OC_2H_5$ | $=CH-(CH=CH)_2-$ | H |
| III-41 | 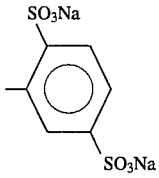 | $-CN$ | $=CH-(CH=CH-)_2$ | H |
| III-42 | $CH_3$ | 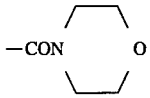 | $=CH-CH=CH-$ | H |

The total amount of the compound of formula (2) to be in the photographic material of the present invention shall be defined from the optical reflective density of the material. Preferably, it may be from 1 mg/m$^2$ to 500 mg/m$^2$, more preferably from 1 mg/m$^2$ to 200 mg/m$^2$, most preferably from 1 mg/m$^2$ to 100 mg/m$^2$.

The photographic material of the present invention may have "colored layer(s) that is/are decolorable by development" along with the water-soluble dye of formula (2). The "colored layer(s) that is/are decolorable by development" may be directly adjacent to the emulsion layers or may be adjacent to them via an interlayer containing gelatin and a color mixing preventing agent such as hydroquinone, etc. It is preferred that the colored layer is positioned under the emulsion layer that is colored to have a primary color of the same kind as that of the color of the colored layer, facing the support. It is possible to either provide different colored layers for all the emulsion layers, each corresponding to the primary color of the individual emulsion layer, or provide them only for some selected emulsion layers. It is also possible to provide colored layer(s) that has/have been colored in correspondence to the region of plural primary colors.

To form the above-mentioned colored layers, any conventional means can be employed. For instance, employable are a method of adding, to a hydrophilic colloid layer, dye(s) such as those described in JP-A 2-282244, from page 3, right top column to page 8 and those described in JP-A 3-7931, from page 3, right top column to page 11, left bottom column, as fine solid dispersion(s); a method of mordanting a cation polymer with anionic dye(s); a method of making dye(s) adsorbed onto fine grains such as silver halide grains so as to fix the dye(s) in emulsion layers; and a method of using a colloidal silver such as that described in JP-A 1-239544. As one example of the method of adding fine solid dispersion(s) of solid dye(s) to a hydrophilic colloid layer, mentioned is the method described in JP-A 2-308244, pages 4 to 13, in which a fine powdery dye which is substantially insoluble in water at least at pH of 6 or less but is substantially soluble in water at least at pH of 8 or more is added to the layer. One example of the method of mordanting a cation polymer with anionic dye(s) is described in JP-A 2-84637, pages 18 to 26. Examples of the method of preparing a colloidal silver as the light absorbent are described in U.S. Pat. Nos. 2,688,601 and 3,459,563. Of these methods, preferred are the method of adding fine powdery dye(s) to a hydrophilic colloid layer and the method of using a colloidal silver.

The photographic material of the present invention contains a compound of the following general formula (1), which will be described in detail.

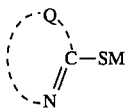

(1)

wherein Q represents an atomic group necessary for forming a 5-membered or 6-membered hetero ring or a 5-membered or 6-membered hereto ring condensed with benzene ring(s); and M represents a cation.

As examples of the hereto ring to be formed by the group of Q, mentioned are imidazole, tetrazole, thiazole, oxazole, selenazole, benzimidazole, naphthimidazole, benzothiazole, naphthothiazole, benzoselenazole, naphthoselenazole and benzoxazole rings.

As examples of the cation represented by M, mentioned are hydrogen ion, alkali metals (e.g., sodium, potassium) and ammonium group.

As the compounds of formula (1), especially preferred are mercapto compounds represented by the following general formulae (1-1), (1-2), (1-3) and (1-4):

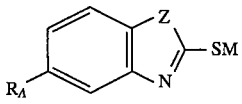

(1-1)

wherein $R_A$ represents a hydrogen atom, an alkyl group, an alkoxy group, an aryl group, a halogen atom, a carboxyl group or its salt, a sulfo group or its salt, or an amino group;

Z represents —NH—, —O—, or —S—;

M has the same meaning as that in formula (1).

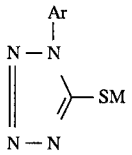

(1-2)

wherein Ar represents

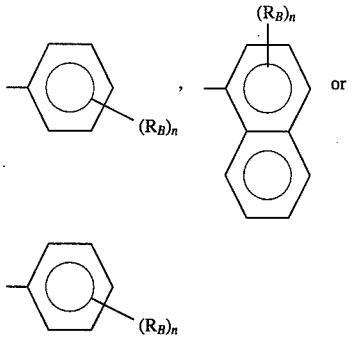

$R_B$ represents an alkyl group, an alkoxy group, a carboxyl group or its salt, a sulfo group or its salt, a hydroxyl group, an amino group, an acylamino group, a carbamoyl group, or a sulfonamido group;

n represents an integer of from 0 to 2;

M has the same meaning as that in formula (1).

In formulae (1-1) and (1-2), the alkyl group of $R_A$ and $R_B$ includes, for example, methyl, ethyl and butyl groups; the alkoxy group includes, for example, methoxy and ethoxy group; the salts of carboxyl group and sulfo groups include, for example, their sodium salts and ammonium salts.

In formula (1-1), the aryl group of $R_A$ includes, for example, phenyl and naphthyl groups; the halogen atom includes, for example, chlorine and bromine atoms.

In formula (1-2), the acylamino group of $R_B$ includes, for example, methylcarbonylamino and benzoylamino groups; the carbamoyl group includes, for example, ethylcarbamoyl and phenylcarbamoyl group; the sulfonamido group includes, for example, methylsulfonamido and phenylsulfonamido groups.

The above-mentioned alkyl, aryl, amino, acylamino, carbamoyl and sulfonamido group may optionally be substituted. As one example of the substituted amino group, mentioned is an alkylcarbamoyl-substituted amino group in which the alkyl moiety has 1 to 32 carbon atoms or, that is, an alkyl-substituted ureido group in which the alkyl moiety has 1 to 32 carbon atoms.

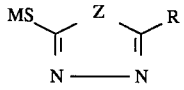

(1-3)

wherein

Z represents —N($R_{A1}$)—, an oxygen atom or a sulfur atom;

R represents a hydrogen atom, an alkyl group, an aryl group, an alkenyl group, a cycloalkyl group, —$SR_{A1}$, —N($R_{A2}$)$R_{A3}$, —NHCO$R_{A4}$, —NHS$O_2R_{A5}$, or a heterocyclic group;

$R_{A1}$ represents a hydrogen atom, an alkyl group, an alkenyl group, a cycloalkyl group, an aryl group, —CO$R_{A4}$, or —S$O_2R_{A5}$;

$R_{A2}$ and $R_{A3}$ each represent a hydrogen atom, an alkyl group, or an aryl group;

$R_{A4}$ and $R_{A5}$ each represent an alkyl group or an aryl group;

M has the same meaning as that in formula (1).

In formula (1-3), the alkyl group of R, $R_{A1}$, $R_{A2}$, $R_{A3}$, $R_{A4}$ and $R_{A5}$ includes, for example, methyl, benzyl, ethyl and propyl groups; and the aryl group includes, for example, phenyl and naphthyl groups.

As one example of the alkenyl group of R and $R_{A1}$, mentioned is a propenyl group; and as one example of the cycloalkyl group, mentioned is a cyclohexyl group. The heterocyclic group of R includes, for example, furyl and pyridyl groups.

The alkyl and aryl groups of the above-mentioned R, $R_{A1}$, $R_{A2}$, $R_{A3}$, $R_{A4}$ and $R_{A5}$, the alkenyl and cycloalkyl groups of R and $R_{A1}$, and the heterocyclic group of R may optionally be substituted by a group, such as an alkyl group, an aryl group, an aralkyl group, an alkenyl group, a halogen atom, an acyl group, an alkoxycarbonyl group, an aryloxycarbonyl group, sulfonic acid group, carboxy group, hydroxy group, an alkoxy group, an aryloxy group, an amido group, sulfamoyl group, carbamoyl group, ureido group, amino group, sulfonyl group, cyano group, nitro group, mercapto group, an alkylthio group, an arylthio group. The heterocyclic group of R preferably includes a 5- and 6-membered ring, such as pyridine ring, imidazole ring, thiazole ring, oxazole ring, pyrimidine ring and pyrrolidine ring.

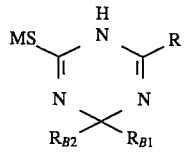

(1-4)

wherein

R and M have the same meanings as those in formula (1-3);

$R_{B1}$ and $R_{B2}$ have the same meanings as $R_{A1}$ and $R_{A2}$, respectively, in formula (1-3).

Specific examples of the compounds of formula (1) are mentioned below, which, however, are not intended to restrict the scope of the present invention.

2-1-1
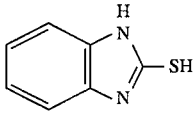
2-1-2
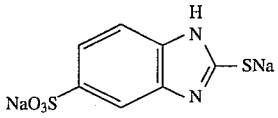
2-1-3
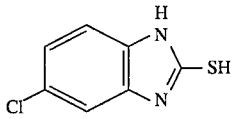
2-1-4
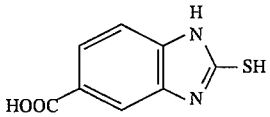
2-1-5
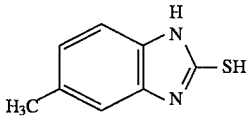
2-1-6
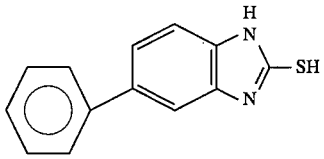
2-1-7
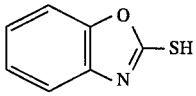
2-1-8
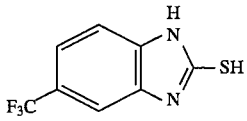
2-2-1
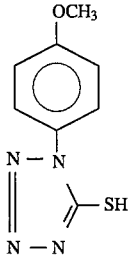
2-2-2
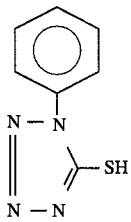

-continued
2-2-3
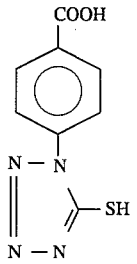
2-2-4
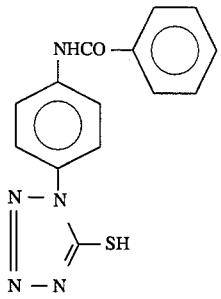
2-2-5
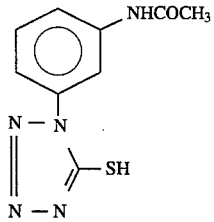
2-2-6
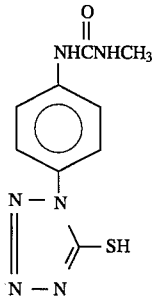
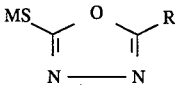
| Compound | R | M |
|---|---|---|
| 2-3-1 | $-C_2H_5$ | $-H$ |
| 2-3-2 | $-CH_2-CH=CH_2$ | $-H$ |
| 2-3-3 | $-CH=CH-CH_2-CH_3$ | $-H$ |
| 2-3-4 | $-C_7H_{15}$ | $-H$ |
| 2-3-5 | $-C_9H_{19}$ | $-Na$ |
| 2-3-6 | 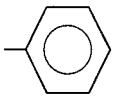 | $-H$ |
| 2-3-7 | $-C_4H_9^{(t)}$ | $-H$ |
| 2-3-8 | 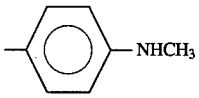  | $-H$ |

-continued
| | | |
|---|---|---|
| 2-3-9 | 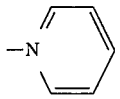 | $-H$ |
| 2-3-10 | 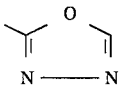 | $-H$ |
| 2-3-11 | 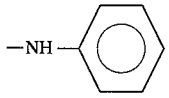 | $-H$ |
| 2-3-12 | 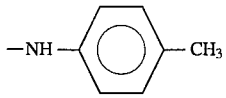 | $-NH_4$ |
| 2-3-13 | $-NHCOCH_3$ | $-H$ |
| 2-3-14 | 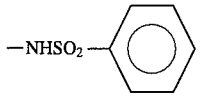 | $-H$ |
| 2-3-15 | $-N(CH_3)_3$ | $-H$ |
| 2-3-16 | 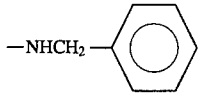 | $-H$ |
| 2-3-17 | 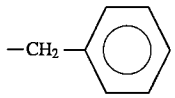 | $-H$ |
| 2-3-18 | $-S-CH_3$ | $-H$ |
| 2-3-19 | 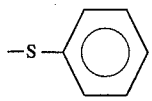 | $-H$ |
| 2-3-20 | $-SH$ | $-H$ |
| 2-3-21 | $-H$ | $-H$ |
| 2-3-22 | $-C_2H_5$ | $-H$ |
| 2-3-23 | $-C_4H_9^{(t)}$ | $-H$ |
| 2-3-24 | $-C_6H_{13}$ | $-H$ |
| 2-3-25 | 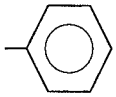 | $-H$ |
| 2-3-26 | 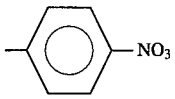 | $-H$ |
| 2-3-27 | 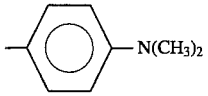 | $-H$ |
| 2-3-28 | 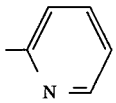 | $-H$ |
| 2-3-29 | 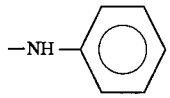 | $-H$ |

-continued
| | | |
|---|---|---|
| 2-3-30 | $-NH_2$ | $-H$ |
| 2-3-31 | $-CH_2CH=CH_2$ | $-H$ |
| 2-3-32 | $-SH$ | $-H$ |
| 2-3-33 | $-NHCOC_2H_5$ | $-H$ |
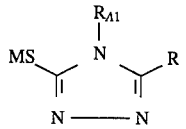
| Compound | R | $R_{A1}$ | M |
|---|---|---|---|
| 2-3-34 | $-C_2H_5$ | $-H$ | $-H$ |
| 2-3-35 | $-CH_3$ | $-CH_3$ | $-H$ |
| 2-3-36 | $-CH_3$ | 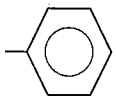 | $-H$ |
| 2-3-37 | $-NHCOCH_3$ | $-CH_3$ | $-H$ |
| 2-3-38 | 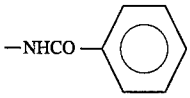 | 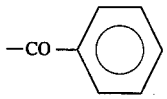 | $-H$ |
| 2-3-39 | $-NHCOCH_3$ | $-COCH_3$ | $-H$ |
| 2-3-40 | $-NHCOCH_3$ | 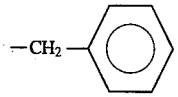 | $-H$ |
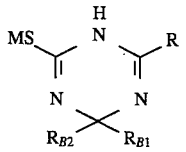
| Compound | R | $R_{B1}$ | $R_{B2}$ | M |
|---|---|---|---|---|
| 2-4-1 | $-C_2H_5$ | $-CH_3$ | $-CH_3$ | $-H$ |
| 2-4-2 | 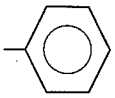 | $-CH_3$ | $-CH_3$ | $-H$ |
| 2-4-3 | $-NH_2$ | $-H$ | 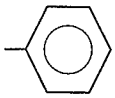 | $-H$ |
| 2-4-4 | 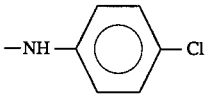 | $-CH_3$ | $-C_4H_9$ | $-H$ |
| 2-4-5 | $-NHCOCH_3$ | $-CH_3$ | $-CH_3$ | $-H$ |
| 2-4-6 | 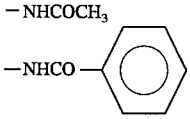 | $-CH_3$ | $-CH_3$ | $-H$ |
| 2-4-7 | 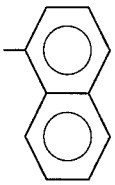 | $-CH_3$ | $-C_3H_7^{(i)}$ | $-H$ |

-continued 2-4-8

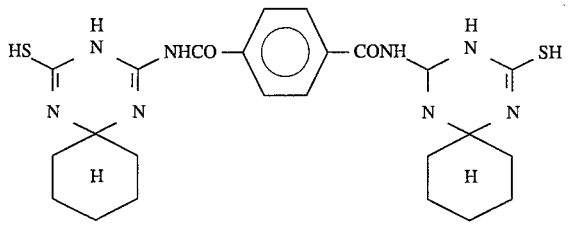

The amount of the compound of formula (1) to be added to the photographic material of the present invention is preferably from $1\times10^{-5}$ to $5\times10^{-2}$ mol, more preferably from $1\times10^{-4}$ to $1\times10^{-2}$ mol, per mol of the silver halide in the material. The time when the compound is added to the material is not specifically defined. The compound may be added thereto at any time during the formation of the silver halide grains for the material, during the physical ripening of the grains, during the chemical ripening of the grains or during the preparation of the coating compositions containing the grains.

The photographic material of the present invention is produced by coating at least one yellow-coloring silver halide emulsion layer, at least one magenta-coloring silver halide emulsion layer and at least one cyan-coloring silver halide emulsion layer on a support having a reflective layer. Ordinary color photographic papers, as containing couplers that form dyes complementary to the light to which the silver halide emulsion containing them is sensitive, are subjected to a subtractive color process for color reproduction. In ordinary color photographic papers, the silver halide emulsion grains to be in the yellow-coloring, magenta-coloring and cyan-coloring layers such as those mentioned above are color-sensitized with blue-sensitive, green-sensitive and red-sensitive dyes, respectively, and these layers may be coated on the support in this order. However, the order of these layers is not definite but any other order different from this may also be employed. As the case may be, it is often preferred to position a light-sensitive layer containing silver halide grains having the largest mean grain size as the outermost layer from the viewpoint of rapidly processing the photographic material; or it is often preferred to position the magenta-coloring light-sensitive layer as the lowermost layer from the viewpoint of improving the storability of the photographic material in the light.

The compound represented by formula (M-1) is described in detail.

$R_2$ represents an alkyl group, preferably a straight or branched alkyl group having 1 to 32 carbon atoms, such as methyl, ethyl, propyl, isopropyl, butyl, t-butyl, i-octyl, tridecyl; a cycloalkyl group, preferably having 3 to 32 carbon atoms, such as cyclopropyl, cyclopentyl, cycohexyl; an alkenyl group, preferably having 2 to 32 carbon atoms, such as vinyl, allyl, 3-butene-1-yl; an aryl group, preferably having 6 to 32 carbon atoms, such as phenyl, 1-naphthyl, 2-naphthyl; a heterocyclic group, preferably, having 1 to 32 carbon atoms, and being comprised of 5- to 8- membered ring, such as 2-thienyl, 4-pyridyl, 2-furyl, 2-pyrimidinyl, 1-pyridyl, 2-benzothiazolyl, 1-imidazolyl, 1-pyrazolyl, benzotriazole-2-yl; cyano group; a halogen atom, such as fluorine atom, chlorine atom, bromine atom; hydroxyl group; nito group; carboxy group; an alkoxy group, preferably having 1 to 32 carbon atoms, such as methoxy, ethoxy, 1-butoxy, 2-butoxy, isopropoxy, t-butoxy, dodecylocy; a cycloalkyloxy group, preferably having 3 to 32 carbon atoms, such as cyclopentyloxy, cyclohexyloxy; an aryloxy group, preferably having 6 to 32 carbon atoms, such as phenoxy, 2-naphthoxy; a heterociclicoxy group, preferably having 1 to 32 carbon atoms, such as 1-phenyltetrazole-5-oxy, 2-tetrahydropyranyloxy, 2-furyloxy; a silyloxy group, preferably having 1 to 32 carbon atoms,such as trimethylsilyloxy, t-butyldimethylsilyloxy, diphenylmethylsilyloxy; an acyloxy group, preferably having 2 to 32 carbon atoms, such as acetoxy, pivaloyloxy, benzoyloxy, dodecanoyloxy; an alkoxycarbonyloxy group, preferably having 2 to 32 carbon atoms, such as ethoxycarbonyloxy, t-butoxycarbonyloxy; a cycloalkoxycarbonyloxy group, preferably 4 to 32 carbon atoms, such as cyclohexyloxycarbonyloxy; an aryloxycarbonyloxy group, preferably having 7 to 32 carbon atoms, such as phenoxycarbonyloxy; a carbamoyloxy group, preferably having 1 to 32 carbon atoms, such as N,N-dimethylcarbamoyloxy, N-butylcarbamoyloxy; a sulfamoyloxy group, preferably having 1 to 32 carbon atoms, such as N,N-diethylsulfamoyloxy, N-propylsulfamoyloxy; an alkanesulfonyloxy group preferably having 1 to 32 carbon atoms, such as methanesulfonyloxy, hexadecanesulfonyloxy; an allenesulfonyloxy group, preferably having 6 to 32 carbon atoms, such as benzenesulfonyloxy; an acyl group, preferably having 1 to 32 carbon atoms, such as formyl, acetyl, pivaloyl, benzoyl, tetradecanoyl; an alkoxycarbonyl group, preferably having 2 to 32 carbon atoms, such as methoxycarbonyl, ethoxycarbonyl, octadecyloxycarbonyl; a cycloalkyloxycarbonyl group, preferably 2 to 32 carbon atoms, such as cyclohexyloxycarbonyl; an aryloxycarbonyl group, preferably 7 to 32 carbon atoms, such as phenoxycarbonyl; a carbamoyl group, preferably having 1 to 32 carbon atoms, such as carbamoyl, N,N-dibutylcarbamoyl, N-ethyl-N-octylcarbamoyl, N-propylcarbamoyl; an amino group, preferably having 32 carbon atoms or less, such as amino, methyamino, N,N-dioctylamino, tetradecylamino, octadecylamino; an anilino group, preferably having 6 to 32 carbon atoms, such as anilino, N-methylanilino; a heterocyclic amino group, preferably 1 to 32 carbon atoms, such as 4-pyridylamino; a carbonamido group, preferably having 2 to 32 carbon atoms, such as acetoamido, benzamido, tetradecanamido; a ureido group, preferably having 1 to 32 carbon atoms, such as ureido, N,N-dimethylureido, N-phenylureido; an imido group, preferably having 10 carbon atoms or less, such as N-succinimido, N-phthalimido; an alkoxycarbonylamino group, preferably having 2 to 32 carbon atoms, such as methoxycarbonylamino, ethoxycarbonylamino, t-butoxycarbonylamino, octadecyloxycarbonylamino; an aryloxycarbonylamino group, preferably having 7 to 32 carbon atoms, such as phenoxycarbonylamino; a sulfonamido group, preferably 1 to 32 carbon atoms, such as methanesulfonamido, butanesulfonamido, benzenesulfonamido, hexadecanesulfonamido; a sulfamoylamino group, preferably 1 to 32 carbon atoms, such as N,N-dipropylsulfamoylamino, N-ethyl-N-dodecylsulfamoylamino; an azo group, preferably having 1 to 32 carbon atoms, such as phenylazo; an alkylthio group, preferably having 1 to 32 carbon atoms, such as ethylthio, octylthio; an arylthio group, preferably 6 to 32 carbon atoms, such as phenylthio; a heterocyclicthio group, preferably having 1 to 32 carbon atoms, such as 2-benzothiazolylthio, 2-pyridylthio, 1-phenyltetrazolylthio; an alkylsufinyl group, preferably having 1 to 32 carbon atoms, such as dodecanesulfinyl; an allenesulfinyl group, preferably having 6 to 32 carbon atoms, such as benzenesulfinyl; an alkanesulfonyl group, preferably 1 to 32 carbon atoms, such as methanesulfonyl, octanesulfonyl; an allenesulfonyl group, preferably 6 to 32 carbon atoms, such as benzenesulfonyl, 1-naphthlenesulfonyl; a sulfamoyl group, preferably 32 carbon atoms or less, such as sulfamoyl, N,N-dipropylsulfamoyl, N-ethyl-N-dodecylsulfamoyl; a sulfo group; a phosphonyl group, preferably having 1 to 32 carbon atoms, such as phenoxyphosphonyl, octyloxyphosphonyl, phenylphosphonyl.

$R_3$ represents the same group as that for $R_2$.

In the formula (Q-1), $R_4$ represents a straight or branched alkyl group having 1 to 32 carbon atoms, or an aryl group having 6 to 32 carbon atoms. The examples for the alkyl groups and the aryl groups are the same as those defined for $R_2$. $R_5$ and $R_6$ each represent the same groups as those for $R_2$. At least two groups of $R_4$, $R_5$ and $R_6$ may be connected to form 5- to 7-memgered carbocyclic or heterocyclic ring ( monocyclic or condensed ring) which is described later.

In the groups represented by the formula (Q-2), $R_7$ represents the same groups as those of $R_4$ in the formula (Q-1), $R_8$ represents the same groups as those of $R_2$, and $R_7$ and $R_8$ may be connected each other to form 5- to 7-membered carbocyclic or heterocyclic ring (monocyclic or condensed ring) which is described later.

In the groups represented by the formula (Q-3), $R_9$ has the same meanings as $R_{10}$.

X represents hydrogen atom or a group capable of being released by a reaction with an oxdized product of developing agent.

The group capable of being released which is represented by X is hydrogen atom, an alkoxy group, an aryloxy group, an acyloxy group, a carbamoyloxy group, a sulfonyloxy group, a carbonamido group, a sulfonamido group, a carbamoylamino group, a heterocyclic group, an arylazo group, an alkylthio group, an arylthio group and a heterocyclicthio group. The preferable carbon atom numbers and examples of the group represented by X are the same as those disclosed for $R_2$. Other than the groups, X may be a bis-type coupler connected to two molecules of 4-equivalent coupler via aldehyde or ketone group. Further, X may be a photographically effective group or precursor thereof, such as a group effective as a development accerelator, a group as a development inhibitor, a group as a desilvering accerelator, a group as a leuco dye, etc.

$R_1$, $R_2$, $R_3$ and X each may have a substituent. Preferable substituent thereof includes a halogen atom, an alkyl group, a cycloalkyl group, an alkenyl group, an aryl group, a heterocyclic group, cyano group, hydroxy group, nitro group, an alkoxy group, an aryloxy group, a heterocyclic oxy group, silyloxy group, an acyloxy group, an alkoxycarbonyloxy group, cycloalkyloxycarbonyloxy group, an aryloxycarbonyloxy group, a carbamoyloxy group, sulfamoyloxy group, an alkanesulfonyloxy group, an allenesulfonyloxy group, carboxy group, an acyl group, an alkoxycarbonyl group, cycloalkyloxycarbonyl group, an aryloxycarbonyl group, carbamoyl group, amino group, anilino group, a heterocyclicamino group, carbonamido group, an alkoxycarbonylamino group, an aryloxycarbonylamino group, ureido group, sulfonamido group, sulfamoylamino group, imido group, an alkylthio group, an arylthio group, a heterocyclicthio group, sufinyl group, sulfo group, an alkanesulfonyl group, allenesufonyl group, sulfamoyl group, phosphonyl group.

The compound represented by the formula (M-1) may form dimers or other polymers via $R_1$, $R_2$, $R_3$ and X.

Preferable compounds represented by the formula (M-1) are disclosed in detail.

In the formula (Q-1), $R_4$ is preferably an alkyl group. Of groups represented by $R_5$ and $R_6$, an alkyl group, a cycloalkyl group, an aryl group, hydroxy group, an alkoxy group, an aryloxy group, amino group, anilino group, a carbonamido group, ureido group, sulfonamido group, sulfamoylamino group, imido group, an alkylthio group and an arylthio group are preferable. Of them, alkyl group, cycloalkyl group, and aryl group are more preferred, and alkyl group is most preferred.

In the formula (Q-2), $R_7$ is preferably an alkyl group, a cycloalkyl group or an aryl group. Of them, secondary or tertiary alkyl group and cycloalkyl group are more preferred.

$R_8$ is preferably an alkyl group, a cycloalkyl group or an aryl group, and of them alkyl group and cycloalkyl group are more preferred.

In the formula (Q-3), $R_9$ and $R_{10}$ each are preferably a halogen atom, an alkyl group a cycloalkyl group, an aryl group, an alkoxy group, an aryloxy group, an acyl group, an alkoxycarbonyl group, a cycloalkyloxycarbonyl group, an aryloxycarbonyl group, carbamoyl group, amino group, anilino group, carbonamido group, an alkoxycarbonylamino group, an aryloxycarbonylamino group, ureido group, sulfonamido group, sufamoylamino group, imido group, an alkylthio group, an arylthio group, heterocyclicthio group, sulfinyl group, an alkanesulfonyl group, an allenesulfonyl group, sulfamoyl group, phosphonyl group. Of them, halogen atom, alkyl group, cycloalkyl group, aryl group, alkoxy group, aryloxy group, amino group, anilino group, carbonamido group, ureido group sufonamido group, sulfamoylamino group, alkylthio group, and arylthio group are more preferred, and alkyl group, cycloalkyl group, aryl group, alkoxy group, aryloxy group, alkylthio group and arylthio group are most preferred.

m is preferably an integer of 0 to 3, and more preferably an integer of 1 or 2.

$R_{10}$ is more preferably substituted at an ortho-position of phenyl group.

$R_1$ is preferably a group represented by the formula (Q-1) or (Q-3), and more preferably the formula (Q-1). Of them, $R_1$ is preferably a group in which $R_4$, $R_5$ and $R_6$ in the formula (Q-1) each are an alkyl group, and more preferably $R_1$ is t-butyl group.

Preferable examples of the group represented by $R_1$ are given below. They are, however, by no means limitative of the scope of the present invention.

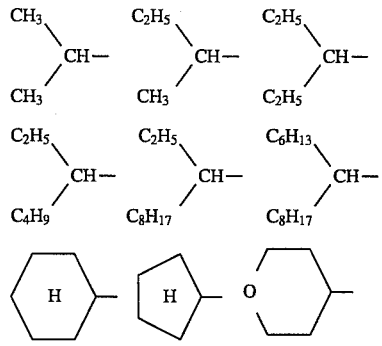

-continued
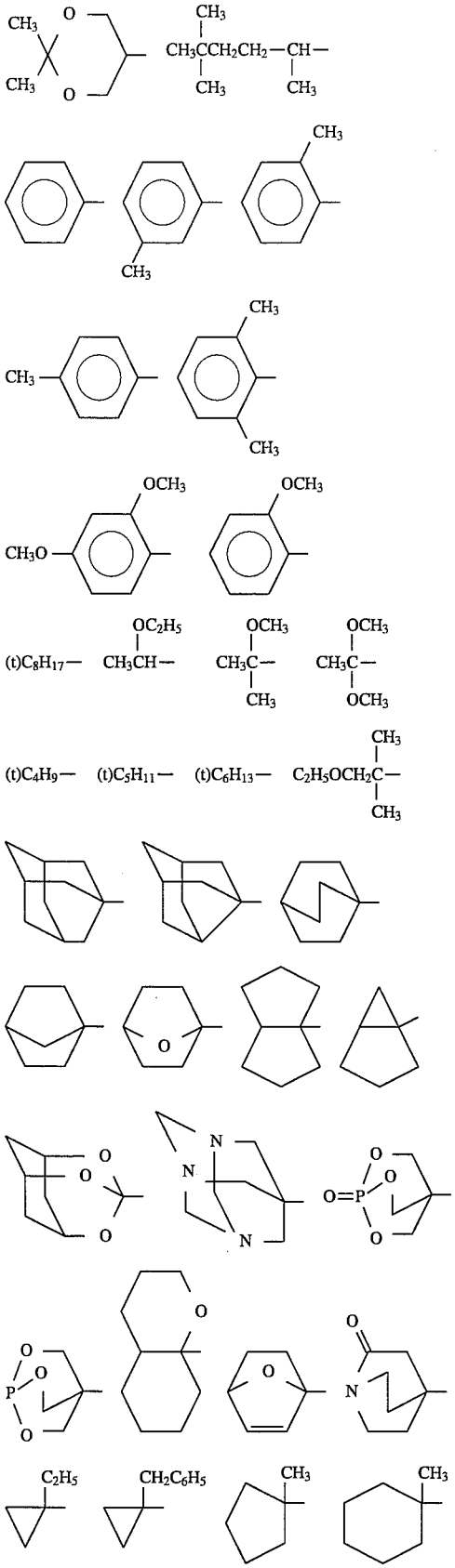
-continued
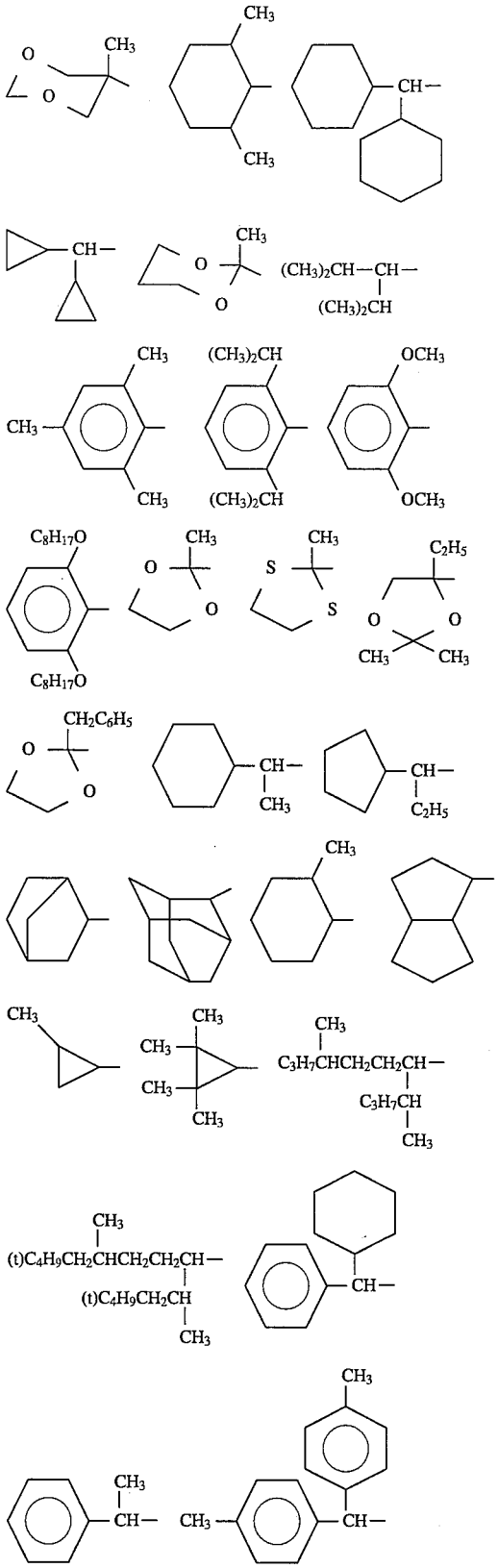

-continued

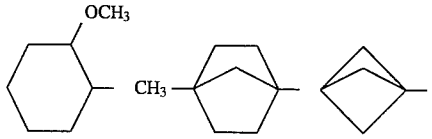

$R_2$ is preferably an alkoxy group, an aryloxy group, an acyloxy group, an alkoxycarbonyloxy group, a cycloalkyloxycarbonyloxy group, an aryloxycarbonyloxy group, carbamoyloxy group, sulfamoyloxy group, an alkanesufonyloxy group, an allenesulfonyloxy group, acyl group, an alkoxycarbonyl group, a cycloalkyloxycarbonyl group, an aryloxycarbonyl group, carbamoyl group, amino group anilino group, carbonamido group, an alkoxycarbonylamino group, an aryloxycarbonylamino group, ureido group, sulfonamido group, sulfamoylamino group, imido group, an alkylthio group, an arylthio group, a heterocyclicthio group, an alkanesulfonyl group an allenesulfonyl group or sufamoyl group, and more preferably an alkoxy group, an aryloxy group, acyl group, an alkoxycarbonyl group, a cycloalkyloxycarbonyl group, an aryloxycarbonyl group, carbamoyl group, amino group, anilino group, carbonamido group, an alkoxycarbonylamino group, an aryloxycarbonylamino group, ureido group, sulfonamido group, sulfamoylamino group, imido group, an alkylthio group, an arylthio group or sulfamoyl group. $R_2$ is preferably substituted at meta- or para-position to a carbon atom connected to pyrazolotriazole ring, and more preferably at para-position $R_3$ is preferably fluorine atom, chlorine atom, bromine atom, an alkyl group, a cycloalkyl group, an aryl group, a heterocyclic group, cyano group, hydroxy group, nitro group, an alkoxy group, an aryloxy group, carboxy group, an acyl group, an alkoxycarbonyl group, an cycloalkyloxycarbonyl group, an aryloxycarbonyl group, carbamoyl group, amino group, anilino group, carbonamido group, an alkoxycarbonylamino group, an aryloxycarbonylamino group, ureido group, sufonamido group, sufamoylamino group, imido group, an alkylthio group, an arylthio group, a heterocyclic thio group, sulfinyl group, sulfo group, an alkanesufonyl group, an allenesulfonyl group, sulfamoyl group or phosphonyl group. n preferably represents an integer of 0 to 3, and more preferably 0 or 1.

X is preferably hydrogen atom, chlorine atom, bromine atom, an aryloxy group, an alkylthio group, an arylthio group, a heterocyclic thio group, or a heterocylcic group, more preferably chlorine atom, an aryloxy group, and most preferably chlorine atom.

Preferable examples of the group represented by X are given below. They are, however, by no means limitative in the scope of the present invention.

$-Cl$ $-F$ $-Br$ $-I$ $-SCH_2CO_2H$

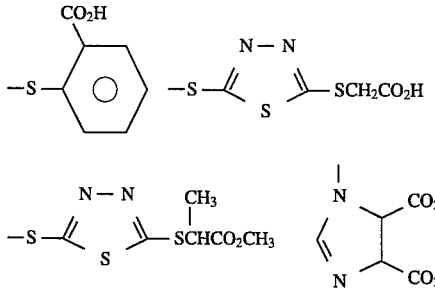

-continued

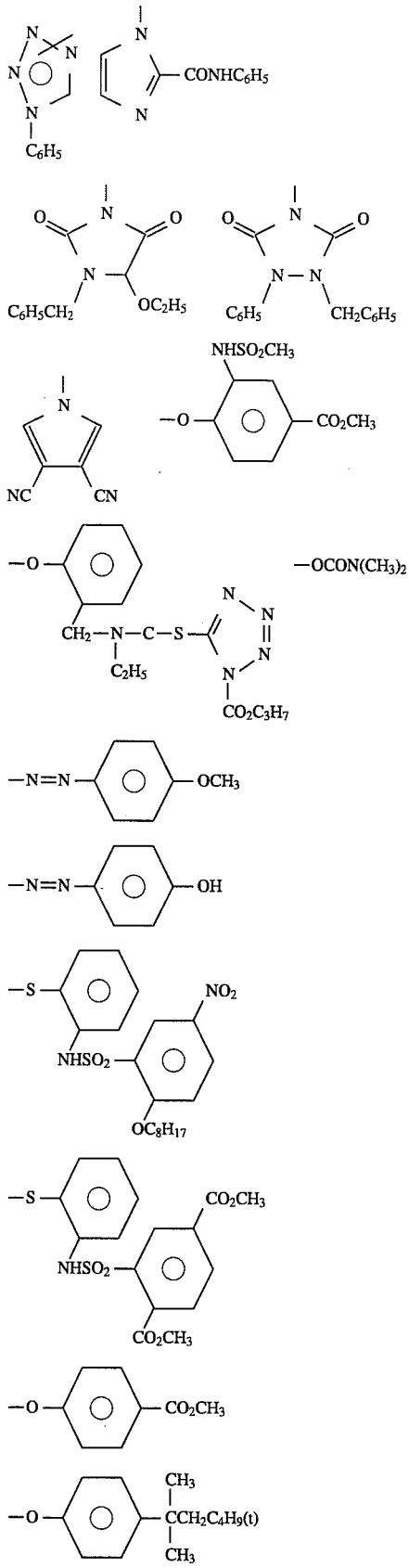

-continued

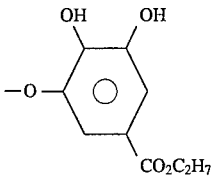

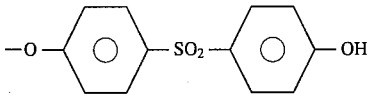

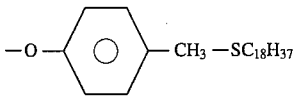

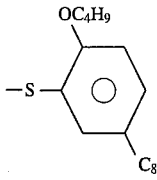

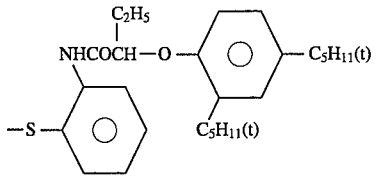

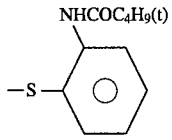

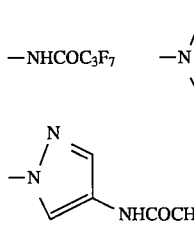

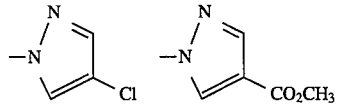

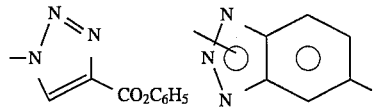

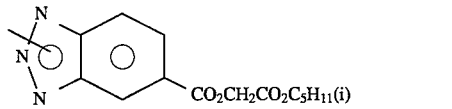

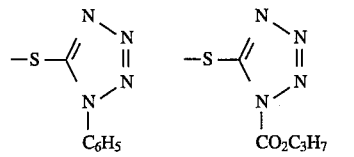

-continued

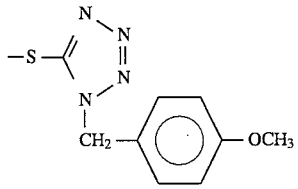

In view of the effects provided by the present invention, of the compounds represented by the formula (M-1), compounds represented by the formula (M-II) are more preferred and compounds represented by the formula (M-III) are most preferred.

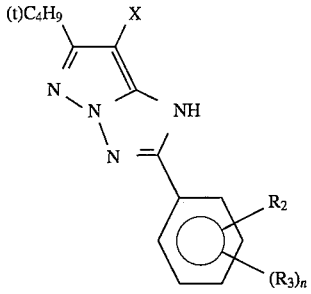

(M-11)

wherein $R_2$,$R_3$, n and X have the same meanings as those in the formula (M-I), respectively.

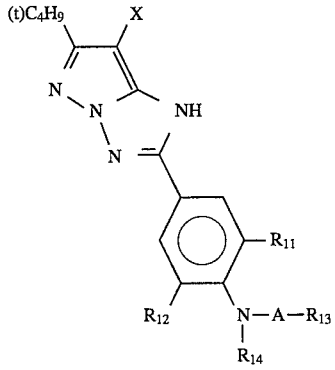

(M-III)

wherein $R_{11}$ and $R_{12}$ each represent hydrogen atom or a substituent, A represents —CO— or —$SO_2$—, $R_{13}$ represents an alkyl group, an aryl group, an alkoxy group, an alkylamino group, or anilino group, $R_{14}$ represents hydrogen atom, an alkyl group, an aryl group, an acyl group, an alkanesulfonyl group, or allenesufonyl group, X represents hydrogen atom or a group capable of being released by a coupling reaction with an oxidation product of developing agent, and $R_{13}$ and $R_{14}$ may be connected each other to form a 5- to 7-membered ring.

In the formula (M-III), $R_{11}$ and $R_{12}$ each are preferably hydrogen atom, fluorine atom, chlorine atom, bromine atom, an alkyl group, a cyclolkyl group, an aryl group, a heterocylic group, cyano group, hedroxy group, nitro group, an alkoxy group, an aryloxy group, carboxy group, an acyl group, an alkoxycarbonyl group, a cycloalkyloxycarbonyl group, an aryloxycarbonyl group, carbamoyl group, amino group, anilino group, carbonamido group, an alkoxycarbonylamino group, an aryloxycarbonylamino group, ureido group, sulfonamido group, sulfamoylamino group, imido group, an alkylthio group, an arylthio group, a heterocyclic thio group, sulfinyl group, sulfo group, an alkanesulfonyl group, an allenesulfonyl group, sulfamoyl group, or phosphonyl group. $R_{13}$ is preferably an alkyl group or an aryl group, and $R_{14}$ is hydrogen atom or an alkyl group. A is more preferably a group of —CO—. X is preferably hydrogen atom, chlorine atom, bromine atom, an aryloxy group, an alkylthio group, an arylthio group, a heterocyclicthio group, or a heterocyclic group, more preferably chlorine atom or an aryloxy group, and most preferably chlorine atom.

Examples of the pyrazolotriazole magenta coupler of formula (M-I) used in the present invention are given below. They are, however, by no means limitative in the scope of the present invention.

M-1

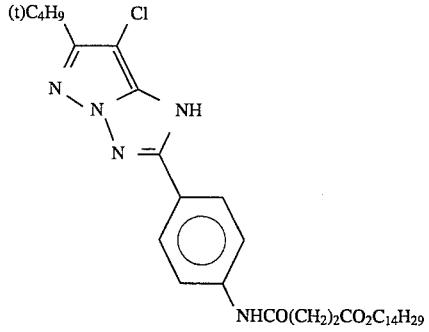

M-2

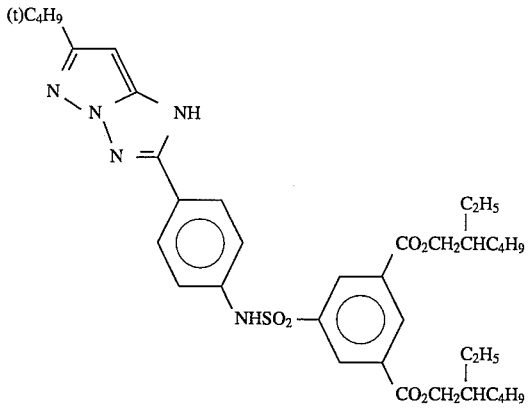

M-3

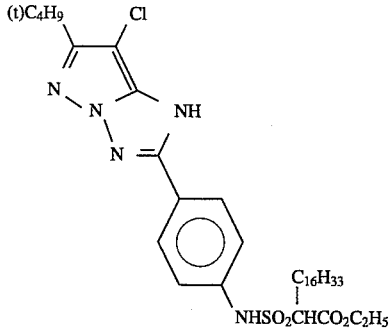

M-4

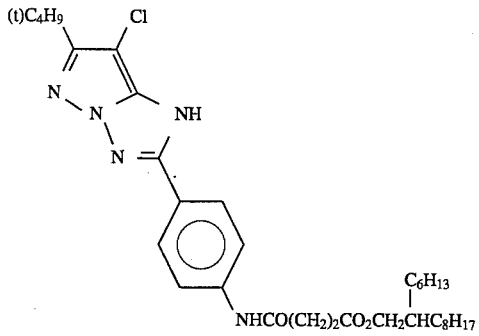

M-5

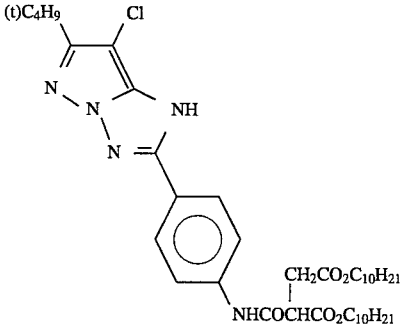

M-6

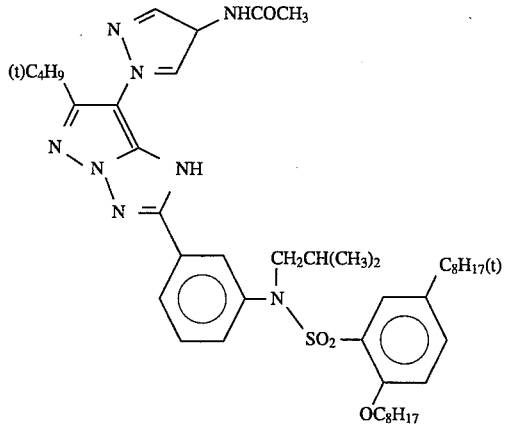

M-7

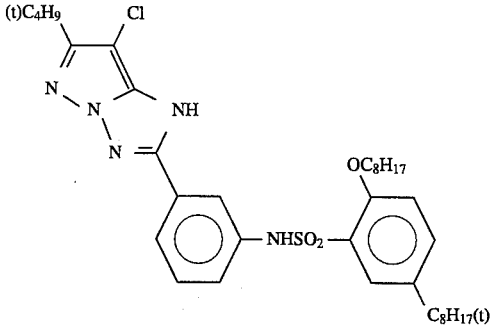

M-8

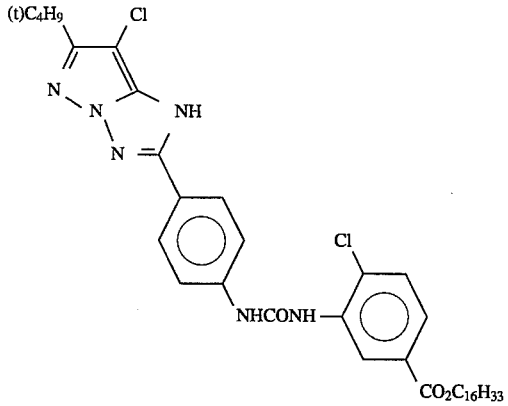

-continued
M-9
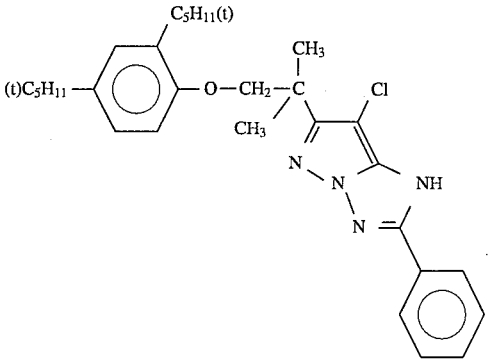
M-10
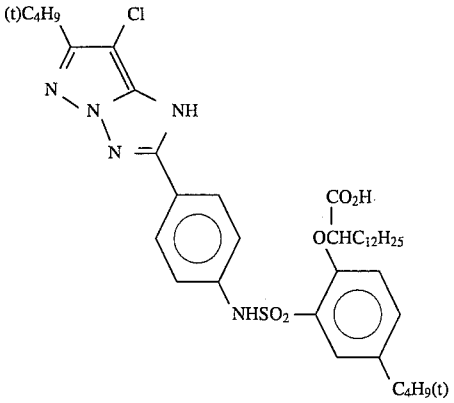
M-11
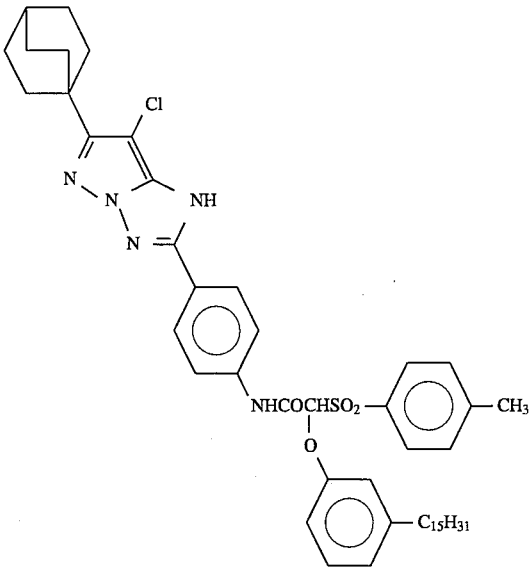
M-12
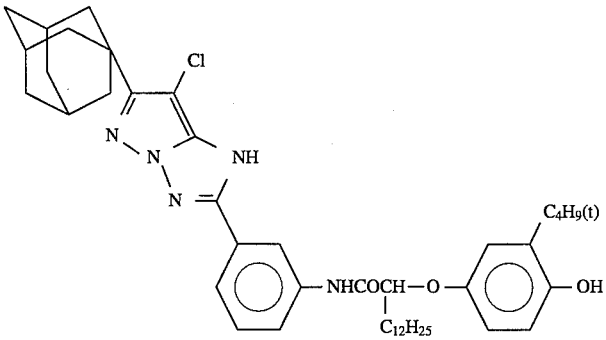

-continued
M-13
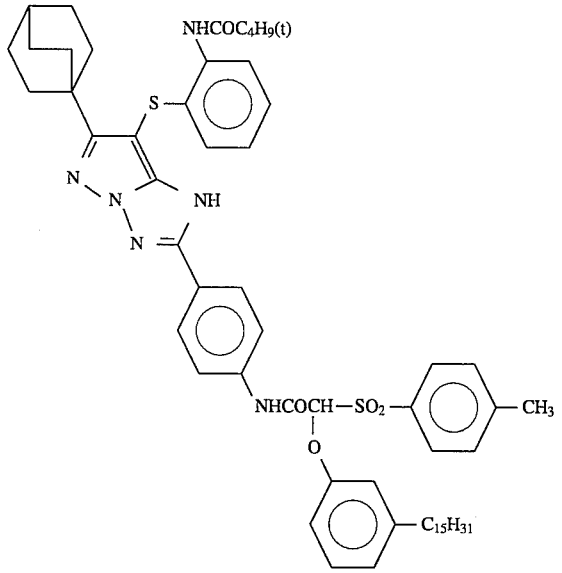
M-14
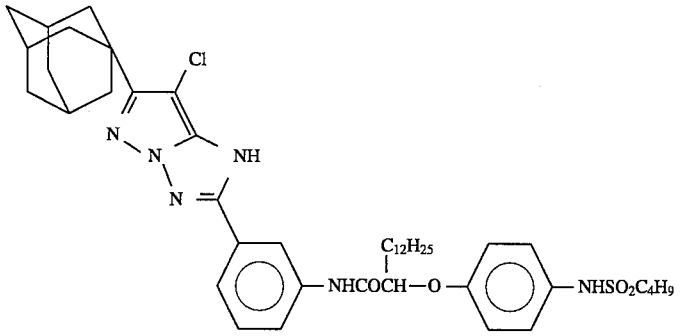
M-15
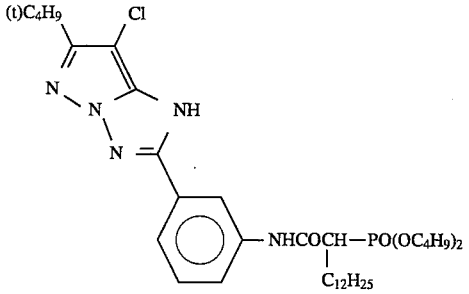
M-16
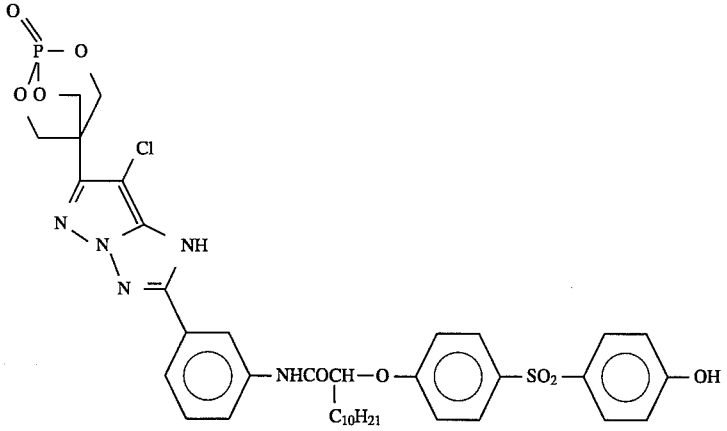

-continued
M-17
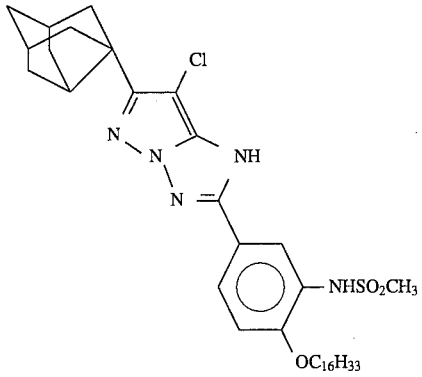
M-18
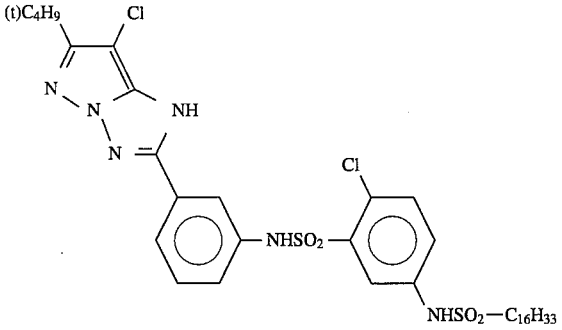
M-19
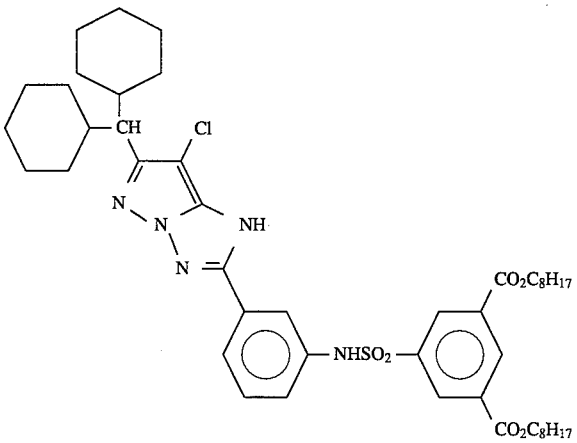
M-20
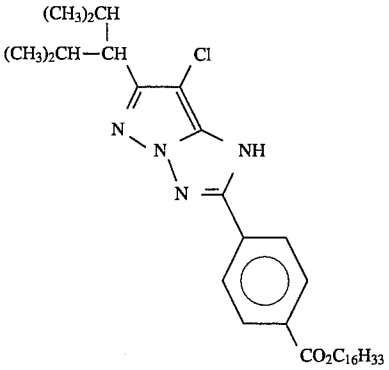

-continued
M-21
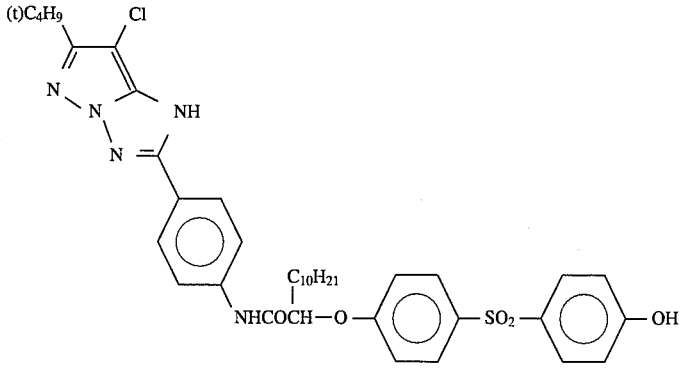
M-22
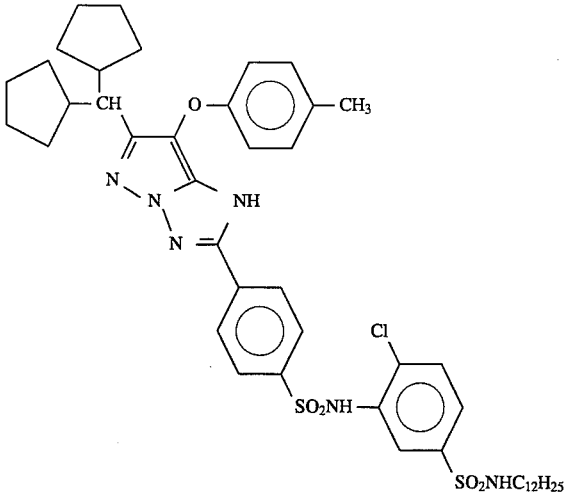
M-23
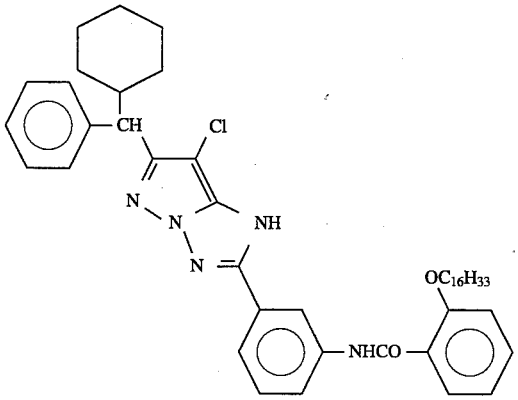
M-24
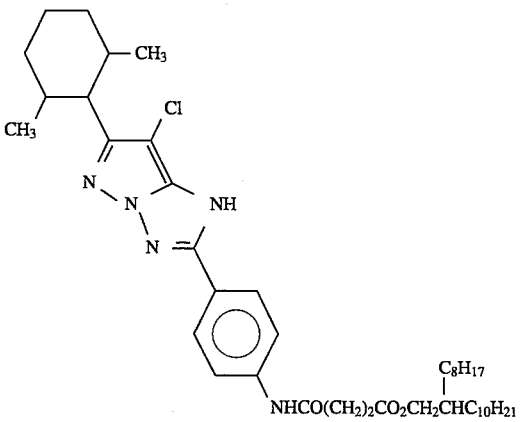
M-25
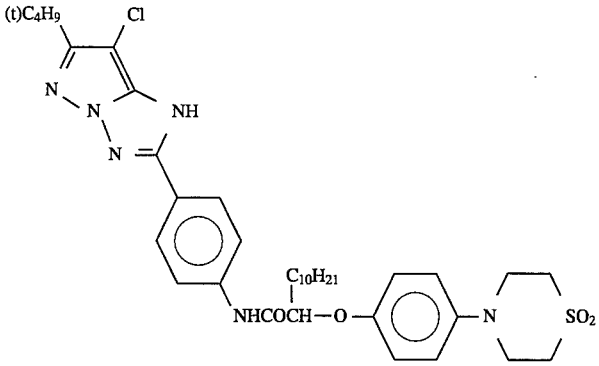

-continued
M-26
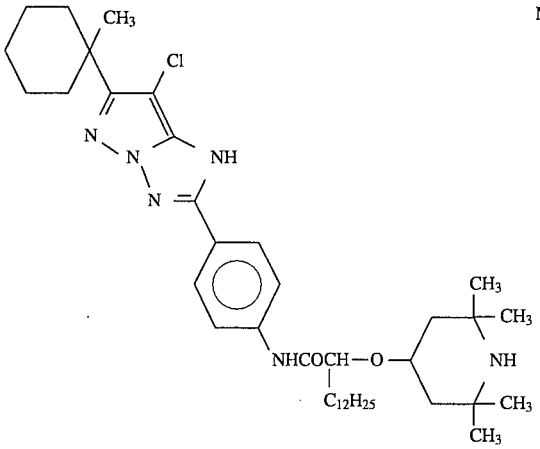
M-27
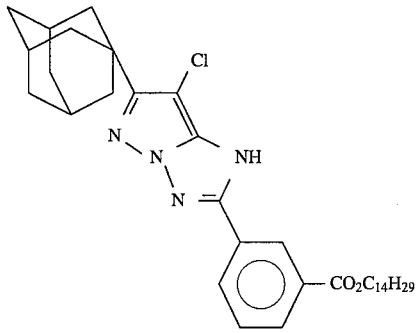
M-28
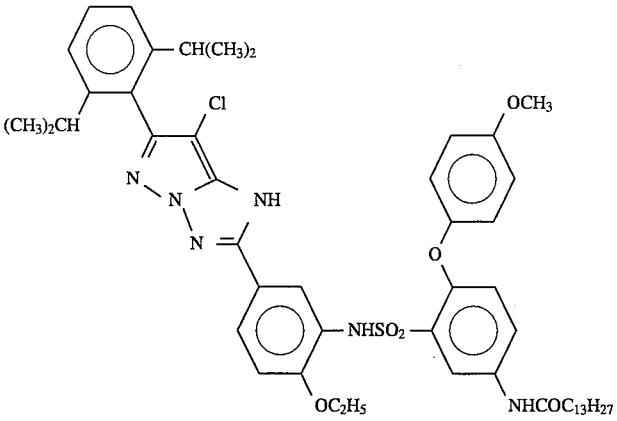
M-29
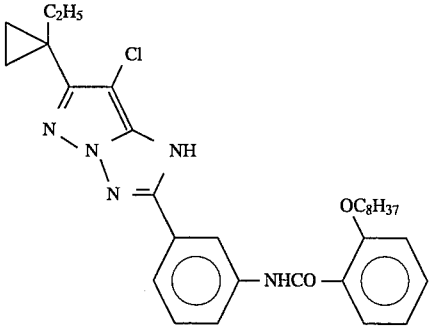
M-30
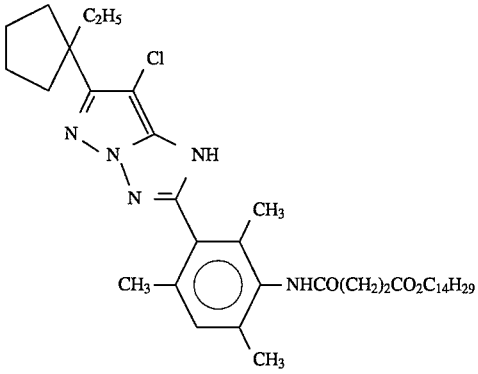
M-31
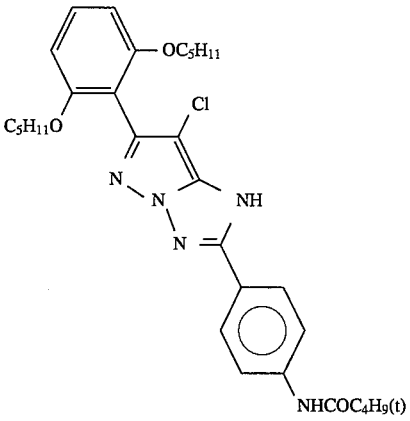

-continued
M-32
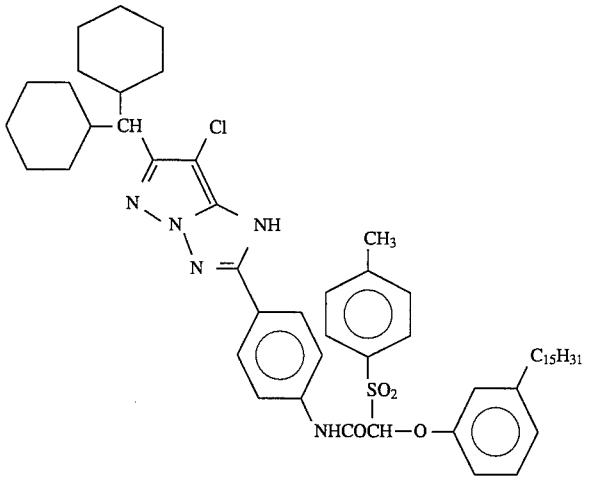
M-33
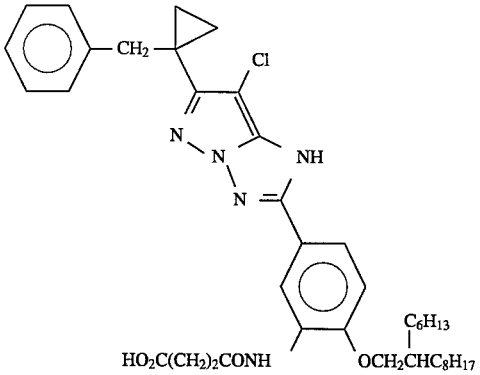
M-34
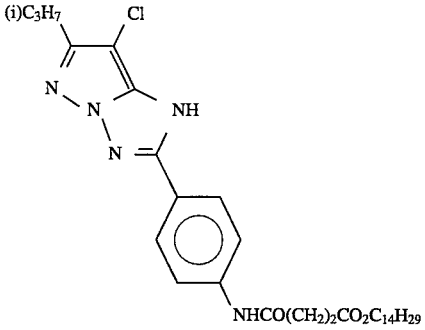
M-35
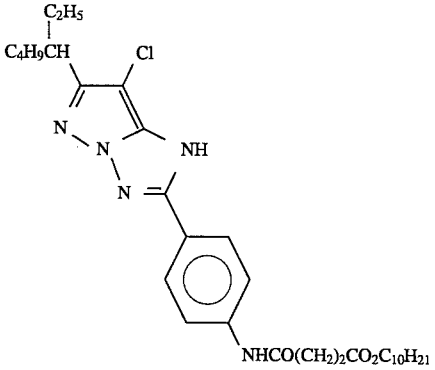
M-36
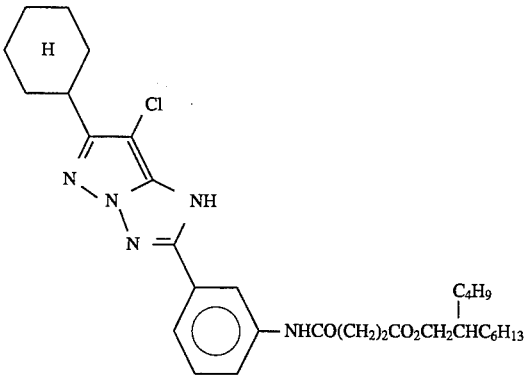
M-37
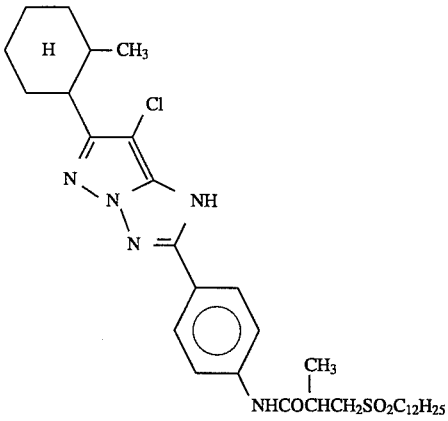
M-38
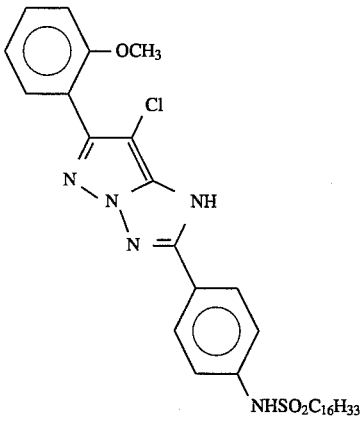

-continued

M-39

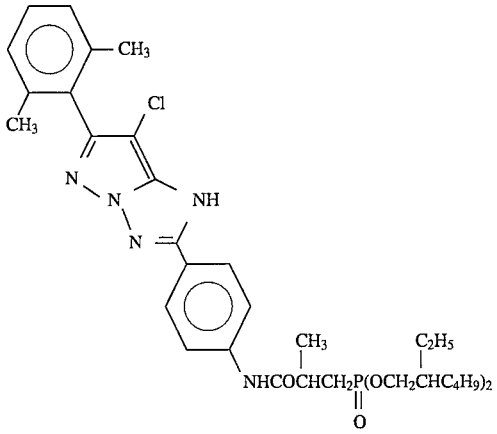

M-40

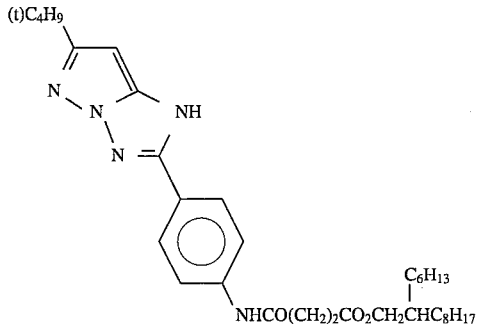

M-41

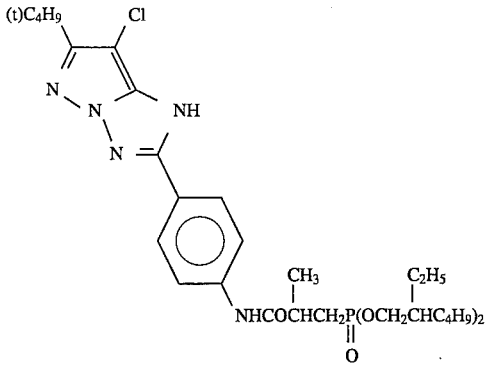

M-42

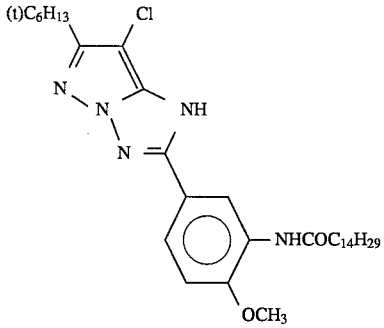

M-43

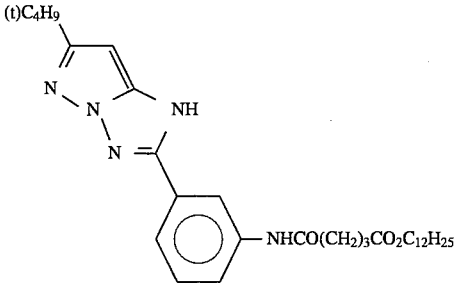

M-44

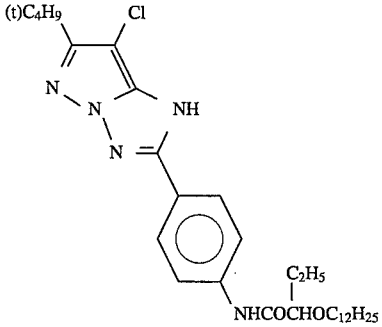

M-45

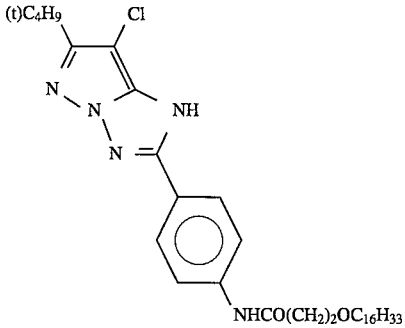

The pyrazolotriazole magenta coupler represented by the formula (M-I) is preferably contained in the silver halide emulsion layer containing high silver chloride content-emulsion grains having 95 mol % or more of silver chloride and compound represented by the formula (1). The coupler is preferably contained in an amount of about 0.1 mol to about 2 mol, and more preferably about 0.2 mol to about 1.2 mol per mol of silver halide in the same layer.

In view of the relationship between the light-sensitive layers and the coloring hues of the layers, the layer construction which is different from those mentioned above may be employed. If desired, at least one infrared-sensitive silver halide emulsion layer may be provided in the photographic material of the present invention.

It is necessary that the color photographic material of the present invention contains, in at least one silver halide emulsion, high silver chloride grains, such as silver chloride grains, silver chlorobromide grains or silver chloroiodobromide grains, having a silver chloride content of 95 mol % or more. Especially preferred are silver chlorobromide or silver chloride grains substantially not containing silver iodide, in order to accelerate the developing time for processing the photographic material. Silver halide grains substantially not containing silver iodide as referred to herein means those having a silver iodide content of 1 mol % or less, preferably 0.2 mol % or less. On the other hand, in order to increase the high intensity sensitivity, to increase the color-sensitized sensitivity or to improve the storage stability of the photographic material, high-silver chloride grains containing from 0.01 to 3 mol % of silver iodide on their surfaces, such as those described in JP-A 3-84545 are also preferably used, as the case may be. Regarding the halogen composition of grains of constituting an emulsion for use in the present invention, the grains may have different halogen compositions. Preferably, however, the emulsion contains grains each having the same halogen composition, as the property of the grains may easily be homogenized. Regarding the halide composition distribution of the grains of constituting a silver halide emulsion for use in the present invention, the grain may have a so-called uniform halogen composition structure where any part of the grain has the same halogen composition; or the grain may have a so-called laminate (core/shell) structure where the halogen composition of the core of the grain is different from that of the shell of the same; or the grain may have a composite halogen composition structure where the inside or surface of the grain has a non-layered different halogen composition part (for example, when such a non-layered different halogen composition part is on the surface of the grain, it may be on the edge, corner or plane of the grain as a conjugated structure). Any of such halogen compositions may properly be selected. In order to obtain a high sensitivity photographic material, the latter laminate or composite halogen composition structure grains are advantageously employed, rather than the first uniform halogen composition structure grains. Such laminate or composite halogen composition structure grains are also preferred for preventing generation of pressure marks. In the case of laminate or composite halogen composition structure grains, the boundary between the different halogen composition parts may be a definite one or may also be an indefinite one of forming a mixed crystal structure because of the difference in the halogen compositions between the adjacent parts. If desired, the boundary between them may positively have a continuous structure variation.

The high-silver chloride grains for use in the present invention are preferably those having layered or non-layered, localized phases of silver bromide in the inside and/or on the surface of the silver halide grain, in the manner as mentioned above. The halide composition in the localized phase is preferably such that the phase has a silver bromide content of at least 10 mol %, more preferably higher than 20 mol %. The silver bromide content in the localized phase may be analyzed by X-ray diffraction (for example, described in *Lecture on New Experimental Chemistry*, No. 6, Analysis of Structure, edited by Japan Chemical Society, published by Maruzen Publishing Co.). The localized phase may be in the inside of the grain and/or on the edges, corners and/or planes of the surface of the grain. As one preferred example, mentioned is an embodiment where the localized phase has grown on the corners of the grain by epitaxial growth.

In order to reduce the amount of the replenisher to the developer to be used in processing the photographic material of the present invention, it is effective to further increase the silver chloride content in the silver halide emulsions constituting the material. In this case, preferably also used are almost pure silver chloride emulsions having a silver chloride content of from 98 mol % to 100 mol %.

The silver halide grains of constituting the silver halide emulsion of the present invention may have a mean grain size of preferably from 0.1 μm to 2 μm. (The grain size indicates a diameter of a circle having an area equivalent to the projected area of the grain, and the mean grain size indicates a number average value to be obtained from the measured grain sizes.)

Regarding the grain size distribution of the emulsion, a so-called monodispersed emulsion having a fluctuation coefficient (to be obtained by dividing the standard deviation of the grain size distribution by the mean grain size) of being 20% or less, preferably 15% or less, more preferably 10% or less is preferred. For the purpose of obtaining a broad latitude, two or more monodispersed emulsions may be blended to form a mixed emulsion for one layer, or they may be separately coated to form plural layers. Such blending or separate coating is preferably effected for this purpose.

Regarding the shape of the silver halide grains of constituting the photographic emulsion of the present invention, the grains may be regular crystalline ones such as cubic, tetradggahedral or octahedral crystalline ones, or irregular crystalline ones such as spherical or tabular crystalline ones, or may be composite crystalline ones composed of such regular and irregular crystalline ones. Mixtures of grains having different crystal forms may also be used in the present invention. The silver halide emulsions constituting the photographic material of the present invention may be of mixtures containing the above-mentioned regular crystalline grains in a proportion of 50% or more, preferably 70% or more, more preferably 90% or more.

Apart from these, silver halide emulsions containing tabular grains having a mean aspect ratio (circle-corresponding diameter/thickness) of 5 or more, preferably 8 or more, in a proportion of 50% or more of the total grains in terms of their projected areas are also preferably used in the present invention.

The silver (bromo)chloride emulsions for use in the present invention may be prepared, for example, by the methods described in P. Glafkides, *Chemie et Phisique Photographique* (published by Paul Montel, 1967); G. F. Duffin, *Photographic Emulsion Chemistry* (published by Focal Press, 1966); and V. L. Zelikman et al., *Making and Coating Photographic Emulsion* (published by Focal Press, 1964). Briefly, they may be prepared by any of acid methods, neutral methods and ammonia methods. As the system of reacting soluble silver salts and soluble halides, employable is any of a single jet method, a double jet method and a combination of them. Also employable is a so-called reversed mixing method where silver halide grains are formed in an atmosphere having excess silver ions. As one system of a double jet method, employable is a so-called controlled double jet method, in which the pAg in the liquid phase where silver halide grains are being formed is kept constant. According to this method, silver halide emulsions comprising regular crystalline grains having nearly uniform grain sizes may be obtained.

It is preferred that the localized phase or the base of the silver halide grain of the present invention contains heterologous metal ions or complex ions. As preferred metal ions for this use, mentioned are metal ions belonging to the Group VIII and the Group IIb of the Periodic Table and their complexes, as well as lead ion and thallium ion. Specifically, the localized phase may contain ions, for example, chosen from among iridium ion, rhodium ion and iron ions and their complex ions while the base may contain ions, for example, chosen from among osmium ion, iridium ion, rhodium ion, platinum ion, ruthenium ion, palladium ion, cobalt ion, nickel ion and iron ion and their complex ions, optionally as combined. The localized phase and the base in one grain may have different contents of different metal ions. They may contain a plurality of such metal ions and complex ions. In particular, it is preferred that the localized phase of silver bromide contains iron and iridium compounds.

Compounds donating such metal ions may be incorporated into the localized phase and/or the other part (base) of the silver halide grains of the present invention, for example, by adding the compound to an aqueous gelatin solution which is to be a dispersing medium, or to an aqueous halide solution, an aqueous silver salt solution or other aqueous solutions at the step of forming the silver halide grains, or in the form of fine silver halide grains containing the metal ions which are dissolved in the system from which the silver halide grains are formed.

The incorporation of the metal ions into the silver halide grains of the present invention may be effected before, during or just after the formation of the grains. The time when the incorporation is effected may be determined, depending on the position of the grain into which the metal ion shall be incorporated.

The silver halide emulsions for use in the present invention are generally subjected to chemical sensitization and color sensitization.

The chemical sensitization includes, for example, chalcogen sensitization using a chalcogen sensitizing agent (such as typically sulfur sensitization using unstable sulfur compounds, selenium sensitization using selenium compounds, tellurium sensitization using tellurium compounds), noble metal sensitization (such as typically gold sensitization) and reduction sensitization, which may be employed singly or as combined. As the compounds to be used for such chemical sensitization, for example, preferred are those described in JP-A 62-215272, from page 18, right bottom column to page 22, right top column.

The emulsions of the layers constituting the photographic material of the present invention are color-sensitized so as to make them sensitive to light falling within a desired wavelength range.

For the color sensitization, used are color-sensitizing dyes effective in making photographic emulsions sensitive to blue, green and red ranges. Such are described in, for example, F. M. Harmer, Heterocyclic Compound—Cyanine Dyes and Related Compounds (John Wiley 7 Sons, New York, London, 1964). Specific examples of color-sensitizing compounds as well as color-sensitizing methods which are preferably employed in the present invention are described in, for example, the above-mentioned JP-A 62-215272, from page 22, right top column to page 38. In particular, the color-sensitizing dyes described in JP-A 3-123340 are especially preferred as red-sensitizing dyes to be applied to silver halide grains having a high silver chloride content, in view of, for example, the high stability of the dyes themselves, the high intensity of adsorption of the dyes to silver halide grains, and the low temperature dependence of the dyes during exposure of photographic materials.

Where the photographic material of the present invention is desired to be made highly sensitive to infrared range, preferably used are the sensitizing dyes described in JP-A 3-15049, from page 12, left top column to page 21, left bottom column; JP-A 3-20730, from page 4, left bottom column to page 15, left bottom column; EP 0420011, from page 4, line 21 to page 6, line 54; EP 0420012, from page 4, line 12 to page 10, line 33; and EP 0443466, U.S. Pat. No. 4,975,362.

To incorporate these color-sensitizing dyes into the silver halide emulsions of the present invention, for example, they may be directly dispersed thereinto, or alternatively, they are first dissolved in a single solvent such as water, methanol, ethanol, propanol, methyl cellosolve, 2,2,3,3-tetrafluoropropanol, etc. or a mixed solvent comprising them, and thereafter the resulting solution may be added to the emulsions. Apart from these cases, the dyes are formed into aqueous solutions in the presence of acids or bases in the manner such as that described in JP-B 44-23389, 44-27555, 57-22089, or are formed into aqueous solutions or colloidal dispersion in the presence of surfactants in the manner such as that described in U.S. Pat. Nos. 3,822,135, 4,006,025, and the resulting solutions or dispersions may be added to the emulsions. Also, they are first dissolved in solvents which are substantially immiscible with water, such as phenoxyethanol, etc. and then dispersed in water or hydrophilic colloids, and the resulting dispersions may be added to the emulsions. Also, they are directly dispersed into hydrophilic colloids in the manner such as that described in JP-A 53-102733, 58-105141, and the resulting dispersions may be added to the emulsions.

Anyhow, the color-sensitizing dyes may be added to the emulsions at any time when the emulsions are prepared and which has heretofore been known acceptable. In other words, the time when the dyes are added to the emulsions may be any of before or during formation of the silver halide grains, immediately after formation of them and before rinsing them, before or during chemical sensitization of them, immediately after chemical sensitization of them and before cooling and solidifying them, and during preparation of coating compositions. More generally, the dyes are added to the emulsions after chemical sensitization of the emulsions and before coating them. If desired, however, the dyes may be added to the emulsions along with chemically-sensitizing dyes so as to effect the color sensitization and the chemical sensitization of the emulsions at the same time, in the manner such as that described in U.S. Pat. Nos. 3,628,969, 4,225,666; or the dyes may be added to the emulsions prior to the chemical sensitization of the emulsions in the manner such as that described in JP-A 58-113928. Apart from these, the color sensitization of the emulsions may be started before the completion of the formation of precipitates of silver halide grains. In addition, it is also possible to divide the color-sensitizing dye to be added into plural parts, which are added to the emulsions at several times, in the manner such as that taught by U.S. Pat. No. 4,225,666. According to the process, for example, a part of the color-sensitizing dye is added to the emulsions prior to the chemical sensitization of them and the remaining part thereof is added thereto after the chemical sensitization. The addition of the color-sensitizing dyes to the photographic emulsions may be effected at any time when the silver halide grains are formed, for example, in accordance with the process taught by U.S. Pat. No. 4,183,756. Of the above-mentioned methods, especially preferred is the method where the dyes are added to the emulsions before the step of rinsing the emulsions or before the step of chemically sensitizing them.

The amount of the color-sensitizing dye to be added varies in a broad range, depending on the case of using it. Preferred is the range of from $0.5\times10^{-6}$ mol to $1.0\times10^{-2}$ mol, more preferably from $1.0\times10^{-6}$ mol to $5.0\times10^{-3}$ mol, relative to one mol of the silver halide to which the dye is added.

When the photographic material of the present invention contains color-sensitizing dyes capable of making it sensitive to light falling within a red to infrared range, it is preferred to incorporate into the photographic material the compounds described in JP-A 2-157749, from page 13, right bottom column to page 22, right bottom column, along with the dyes. Using these compounds, the storability of the photographic material, the stability during processing the material and the supercolor-sensitizing effect of the material may be specifically improved. Above all, the compounds of formulae (IV), (V) and (VI) described in said patent publication are especially preferred. The compound is added to the photographic material in an amount of from $0.5\times10^{-5}$ mol to $5.0\times10^{-2}$ mol, preferably from $5.0\times10^{-5}$ mol to $5.0\times10^{-3}$ mol, relative to one mol of the silver halide in the material. The effective range of the amount of the compound to be added is from 0.1 to 10000 molar times, preferably from 0.5 to molar 5000 times the sensitizing dye to be combined with the compound.

The photographic material of the present invention may be applied to a printing system using an ordinary negative printer. In addition to this, the material is also preferably applied to digital scanning exposure using monochromatic high-density lights such as gas lasers, light-emitting diodes, semiconductor lasers, or secondary high-harmonics generating light sources (SHG) comprising a combination of a semiconductor laser or a solid laser where a semiconductor laser is used as an exciting light source and non-linear optical crystals. In order to make the system compact and low-priced, use of semiconductor lasers or secondary high-harmonics generating light sources (SHG) comprising a combination of a semiconductor laser or solid laser and non-linear optical crystals is preferred. In particular, in order to design a low-priced, long-life and highly-safe device, use of semiconductor lasers is preferred, and it is desired to use a semiconductor laser as at least one light source for exposure.

As the binder or protective colloid which may be used in the photographic material of the present invention, gelatin is preferred but any other hydrophilic colloid may also be used singly or along with gelatin. As the gelatin, preferred is a low-calcium gelatin having a calcium content of 800 ppm or less, more preferably 200 ppm or less. In order to prevent the growth of various fungi or bacteria, which grow in hydrophilic colloid layers to worsen the image quality of the images to be formed, it is preferred to add an anti-microbial agent such as that described in JP-A 63-271247 to the hydrophilic colloid layers constituting the photographic material of the present invention.

Where the color photographic material of the present invention is subjected to printer exposure, this can be exposed via a developed color negative film having plural image planes (frames) with different aspect ratios, using a printer provided with a variable mask and a zoom mechanism. In this case where the aspect ratios of the image planes to be printed on the color photographic material of the present invention are varied, the upper and lower portions of one image plane (frame) of the negative film may be cut off or two consecutive image planes of the negative film are used at the same time. In this way, so-called panorama-size or high-vision-size prints can be obtained.

Where the color photographic material of the present invention is subjected to printer exposure, it is preferred to use a band-stop filter such as that described in U.S. Pat. No. 4,880,726. Using this, color mixing may be inhibited so that the color reproducibility of the photographic material is noticeably improved.

The exposed photographic material of the present invention is processed according to conventional color development. To rapidly process it, the material is, after having been subjected to color development, preferably blixed. In particular, when the material contains the above-mentioned high-silver chloride emulsions, the pH value of the blixer to be used is preferably about 6.5 or less, more preferably about 6 or less, so as to promote the desilvering of the material.

As the silver halide emulsions and other elements (e.g., additives) of constituting the photographic material of the present invention, the photographic layers of constituting the material, the arrangement of the layers, the methods of processing the material and the additives usable in the processing methods, those described in the following patent publications, especially in European Patent 0,355,660A2 (corresponding to JP-A 2-139544), are preferably employed.

| Photographic Elements | JP-A 62-215272 | JP-A 2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower | — | — |

-continued

| Photographic Elements | JP-A 62-215272 | JP-A 2-33144 | EP 0,355,660A2 |
|---|---|---|---|
| | column, line 1 to page 91, right upper column, line 3 | | |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 8, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper, column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents | From page 210, left lower column, line 1 to page 222, left lower column, line 5 | From page 25, left upper column, line 1 to page 27, right lower column, line 9 | — |
| Binders (hydropbilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper | — | — |

-continued

| Photographic Elements | JP-A 62-215272 | JP-A 2-33144 | EP 0,355,660A2 |
|---|---|---|---|
| | column, last line | | |
| Photographic Processing Methods (Processing steps and additives) | From page 3, right upper column, line 7 to page 10, right upper column, line 5 | From page 39, left upper column, line 4 to page 42, left upper column, last line | From page 67, line 14 to page 69, line 28 |

The cited specification of JP-A 62-215272 is one as amended by the letter of amendment filed on March 16, 1987.
In addition to the above-mentioned couplers, so-called shortwave-type yellow couplers such as those described in JP-A 63-231451, 63-123047, 63-241547, 1-173499, 1-213648 and 1-250944 are also preferably used.

It is preferred that cyan, magenta or yellow couplers are infiltrated into loadable latex polymers (for example, those described in U.S. Pat. No. 4,203,716) in the presence or absence of high boiling point organic solvents such as those referred to in the above-mentioned table or are dissolved in such solvents along with water-insoluble and organic solvent-soluble polymers and are emulsified and dispersed in aqueous solutions of hydrophilic colloids. As preferred water-insoluble and organic solvent-soluble polymers, for example, mentioned are homopolymers or copolymers described in U.S. Pat. No. 4,857,449, columns 7 to 15 and International Patent Laid-Open No. W088/00723, pages 12 to 30. In particular, methacrylate or acrylamide polymers, especially acrylamide polymers are preferably used in view of the high stability of color images to be formed.

It is preferred that the photographic material of the present invention contains color image stability improving compounds such as those described in EP 0,277,589A2 along with couplers. In particular, such compounds are preferably combined with pyrazoloazole couplers and pyrrolotriazole couplers.

Specifically, it is preferred to add to the photographic material of the present invention compounds capable of chemically bonding to the aromatic amine developing agent remaining in the material after its color development to form therein substantially colorless compounds which are chemically inactive, such as those described in the above-mentioned patent specifications and/or compounds capable of chemically bonding to the oxidation product of an aromatic amine developing agent remaining in the material after its color development to form therein substantially colorless compounds which are chemically inactive, such as those described in the above-mentioned patent specifications, singly or as combined, since the compounds added to the material can prevent the color developing agent or its oxidation product remaining in the processed material from reacting with the couplers in the material to form stains or can prevent other harmful side effects while the processed material is stored.

As cyan couplers to be in the photographic material of the present invention, preferred are diphenylimidazole cyan couplers such as those described in JP-A 2-33144 as well as 3-hydroxypyridine cyan couplers such as those described in EP 0333185A2 (especially preferably, one of 4-equivalent couplers illustrated therein, Coupler (42), into which splitting-off chloride groups have been introduced so as to make it 2-equivalent, and Couplers (6) and (9)), active acyclic methylene cyan couplers such as those described in JP-A 64-32260 (especially preferably, Couplers 3, 8 and 34 illustrated therein), pyrrolopyrazole cyan couplers such as those described in EP 0456226A1, pyrroloimidazole cyan couplers such as those described in EP 0484909, and pyrrolotriazole cyan couplers such as those described in EP 0488248 and EP 0491197A1. Of these, especially preferred are pyrrolotriazole cyan couplers.

As yellow couplers also to be in the photographic material of the present invention, preferably used are acylacetamide yellow couplers where the acyl group has a 3-membered to 5-membered cyclic structure, such as those described in European Patent 0447969A1; malondianilide yellow couplers having a cyclic structure such as those described in European Patent 0482552A1; and acylacetamide yellow couplers having a dioxane structure such as those described in U.S. Pat. No. 5,118,599, in addition to the compounds described in the above-mentioned table. Above all, acylacetamide yellow couplers where the acyl group is an 1-alkylcyclopropane-1-carbonyl group, and malondianilide yellow couplers where one anilide constitutes an indoline ring are especially preferably used. These couplers may be used singly or as combined.

As magenta couplers to be used together with the coupler of formula (M-1) disclosed above in the photographic material of the present invention, mentioned are 5-pyrazolone magenta couplers and pyrazoloazole magenta couplers such as those described in the above-mentioned patent publications. In particular, however, especially preferred are pyrazolotriazole couplers where a secondary or tertiary alkyl group is directly bonded to the 2, 3 or 6-position of the pyrazototriazole ring, such as those described in JP-A 61-65245; pyrazoloazole couplers having a sulfonamido group in the molecule, such as those described in JP-A 61-65246; pyrazoloazole couplers having an alkoxyphenylsulfonamido ballast group, such as those described in JP-A 61-147254; and pyrazoloazole couplers having a 6-positioned alkoxy or aryloxy group, such as those described in European Patents 226,849A and 294,785A, in view of the color hue and the stability of images to be formed therefrom and of the coloring property of themselves.

To process the color photographic material of the present invention, the processing materials and the processing methods described in JP-A 2-207250, from page 26, right bottom column, line 1 to page 34, right top column, line 9 and JP-A 4-97355, from page 5, left top column, line 17 to page 18, right bottom column, line 20 are preferably employed, in addition to those referred to in the above-mentioned table.

The present invention will be explained in more detail by means of the following examples, which, however, are not intended to restrict the scope of the present invention.

EXAMPLE 1

Preparation of Base Paper:

A wood pulp mixture (LBKP/NBSP=2/1) was beaten to prepare 250 cc of a pulp slurry of Canadian Freeness. Next, this pulp slurry was diluted with water, and 1.0%, relative to the pulp, of anionic polyacrylamide (Polystron 195 having a molecular weight of about 1,100,000; produced by Arakawa Chemical Co.), 1.0%, relative to the pulp, of aluminium sulfate and 0.15%, relative to the pulp, of polyamido-polyamine-epichlorohydrin (Kymen 557; produced by Dick Hercules Co.) were added thereto, while stirring. In addition, 0.4% by weight, relative to the pulp, of epoxidated behenic acid amide and 0.4% by weight, relative to the pulp, of alkylketene dimer (where the alkyl group is $C_{20}H_{41}$) were added thereto. The resulting mixture was adjusted to have pH of 7, by adding sodium hydroxide thereto. 0.5%, relative to the pulp, of cationic polyacrylamide and 0.1%, relative to the pulp, of a defoaming agent were added thereto. The thus-processed pulp slurry was sheeted into a base paper having a weight of 180 g/m$^2$.

been prepared as above, through the T-die of the extruder. Thus, a laminate layer (resin layer) having a thickness of 30 μm was formed on the surface of the base paper. Onto the other surface of the base paper, a resin composition comprising polyethylene and calcium carbonate was melt-extruded at 300° C. to form a laminate layer (resin layer) having a thickness of 30 μm thereon. Thus, support B was formed.

In the same manner as above, reflective supports A to U having the resin layers shown in Table 1 below were formed.

The surface, which shall be coated with photographic emulsions, of each of these reflective supports thus formed was subjected to corona discharging treatment and was coated with a subbing layer of gelatin containing sodium dodecylbenzenesulfonate.

TABLE 1

| | First Layer (facing emulsion layers) | | Second Layer | | Third Layer (facing substrate) | | |
|---|---|---|---|---|---|---|---|
| Support | Thickness (μm) | $TiO_2$ Content (wt. %) | Thickness (μm) | $TiO_2$ Content (wt. %) | Thickness (μm) | $TiO_2$ Content (wt. %) | Ultramarine (wt. %) |
| A | 15 | 30 | 15 | 0 | — | — | — |
| B | 30 | 30 | — | — | — | — | — |
| C | 13 | 0 | 15 | 30 | 2 | 0 | 8 |
| D | 2 | 0 | 15 | 30 | 13 | 0 | 8 |
| E | 5 | 0 | 15 | 30 | 10 | 0 | 8 |
| F | 8 | 0 | 15 | 30 | 7 | 0 | 8 |
| G | 2 | 5 | 15 | 30 | 13 | 0 | 8 |
| H | 2 | 10 | 15 | 30 | 13 | 0 | 8 |
| I | 2 | 20 | 15 | 30 | 13 | 0 | 8 |
| J | 2 | 30 | 15 | 30 | 13 | 0 | 8 |
| K | 2 | 0 | 15 | 30 | 13 | 5 | 8 |
| L | 2 | 0 | 15 | 30 | 13 | 10 | 8 |
| M | 2 | 0 | 15 | 30 | 13 | 20 | 8 |
| N | 2 | 0 | 15 | 30 | 13 | 30 | 8 |
| O | 2 | 0 | 15 | 5 | 13 | 0 | 8 |
| P | 2 | 0 | 15 | 10 | 13 | 0 | 8 |
| Q | 2 | 0 | 15 | 15 | 13 | 0 | 8 |
| R | 2 | 0 | 15 | 20 | 13 | 0 | 8 |
| S | 2 | 0 | 15 | 40 | 13 | 0 | 8 |
| T | 2 | 0 | 15 | 50 | 13 | 0 | 8 |
| U | 2 | 0 | 15 | 30 | 13 | 0 | 0 |

Next, this base paper was dried in an oven to have a water content of about 2%. An aqueous solution of a surface sizing agent having the composition mentioned below was applied to the surface (to be coated with photographic emulsions) of the base paper under pressure, by which the surface of the base paper was coated with 20 g/m$^2$ of the sizing agent.

Composition of Surface Sizing Agent:

| | |
|---|---|
| Polyvinyl Alcohol: | 4.0% |
| Calcium Chloride: | 4.0% |
| Brightening Agent: | 0.5% |
| Defoaming Agent: | 0.005% |

Next, the surface of the base paper thus coated with the sizing agent was treated with a machine calender, by which the thickness of the base paper was reduced to 180 μm.

Preparation of Photographic Supports:

Using a double-screw extruder, a mixture of polyethylene and titanium oxide (KA-10; produced by Titanium Industry Co.) was melted and extruded, at 300° C., onto the surface of the base paper (having a thickness of 180 μm) that had Formation of Emulsions-Coated Samples:

Plural photographic constitutive layers were coated on support A to prepare a multi-layered color photographic paper (sample No. 104) having the layer constitution mentioned below. Coating liquids for the layers were prepared in the manner mentioned below.

Preparation of Coating Liquid for First Layer:

153.0 g of yellow coupler (ExY), 15.0 g of color image stabilizer (Cpd-1), 7.5 g of color image stabilizer (Cpd-2), 16.0 g of color image stabilizer (Cpd-3) and 7.5 g of color image stabilizer (Cpd-5) were dissolved in 25 g of solvent (Solv-1), 25 g of solvent (Solv-5) and 180 cc of ethyl acetate, and the resulting solution was emulsified and dispersed in 1000 g of an aqueous solution of 10% gelatin containing 60 cc of 10% sodium dodecylbenzenesulfonate to prepare emulsified dispersion A. On the other hand, silver chlorobromide emulsion A was prepared. This was a 3/7 (as silver molar ratio) mixture comprising a large-size emulsion A of cubic grains with a mean grain size of 0.88 μm and a small-size emulsion A of cubic grains with a mean grain size of 0.70 μm, in which the two emulsions each had a fluctuation coefficient of grain size distribution of 0.08 and 0.10, respectively, and each contained silver chlorobromide grains each having 0.3 mol % of AgBr locally on the surfaces of the base grains composed of silver chloride. The large-size emulsion A contained blue-sensitizing dyes A, B and C mentioned below, in an amount of $1.4\times10^{-4}$ mol, per mol of silver, each; and the small-size emulsion A contained them in an amount of $1.7\times10^{-4}$ mol, per mol of silver, each. This silver chlorobromide emulsion A was chemically sensitized by sulfur sensitization and gold sensitization. The above-mentioned emulsified dispersion A and this silver chlorobromide emulsion A were mixed and formed into a coating liquid for the first layer having the composition mentioned below. The amounts of the emulsions coated are in terms of the amounts of silver therein.

Coating liquids for the second layer to the seventh layer were prepared in the same manner as above. As the gelatin hardening agent in each layer, used was sodium 1-hydroxy-3,5-dichloro-s-triazine.

To each layer, added were 25.0 mg/m$^2$ of Cpd-12 and 50.0 mg/m$^2$ of Cpd-13.

The following color-sensitizing dyes were added to the silver chlorobromide emulsions in the light-sensitive emulsion layers.

Blue-sensitive Emulsion Layer:

Sensitizing Dye A:

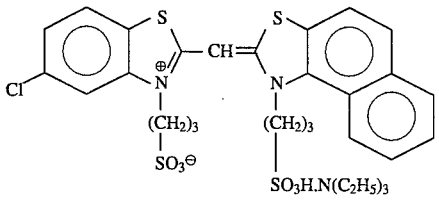

Sensitizing Dye B:

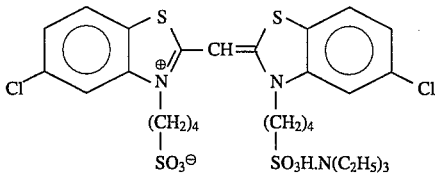

Sensitizing Dye C:

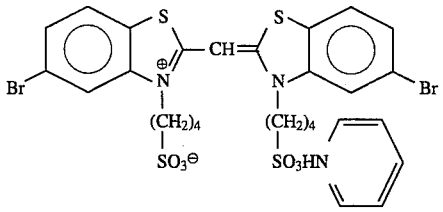

(These were added each in an amount of $1.4\times10^{-4}$ mol per mol of silver halide to the large-size emulsion and $1.7\times10^{-4}$ mol per mol of silver halide to the small-size emulsion.)

Green-sensitive Emulsion Layer:

Sensitizing Dye D:

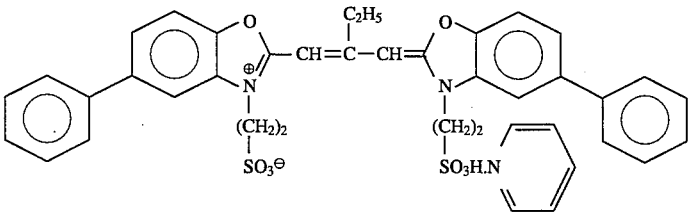

Sensitizing Dye E:

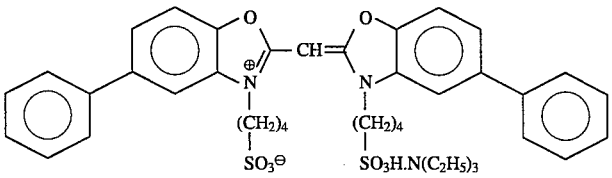

Sensitizing Dye F:

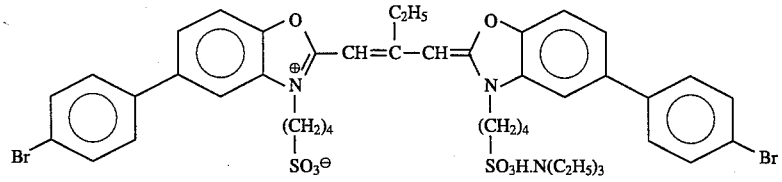

(Sensitizing dye D was added in an amount of $3.0\times10^{-4}$ mol per mol of silver halide to the large-size emulsion and $3.6\times10^{-4}$ mol per mol of silver halide to the small-size emulsion; Sensitizing dye E was added in an amount of $4.0\times10^{-5}$ mol per mol of silver halide to the large-size emulsion and $7.0\times10^{-5}$ mol per mol of silver halide to the small-size emulsion; and Sensitizing dye F was added in an amount of $2.0\times10^{-4}$ mol per mol of silver halide to the large-size emulsion and $2.8\times10^{-4}$ mol per mol of silver halide to the small-size emulsion)

Red-sensitive Emulsion Layer:

Sensitizing Dye G:

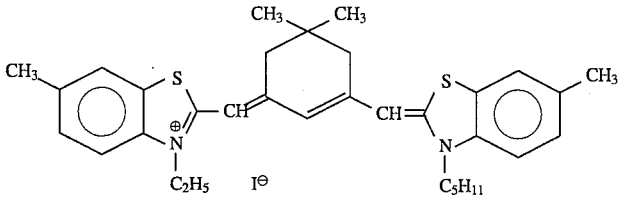

Sensitizing Dye H:

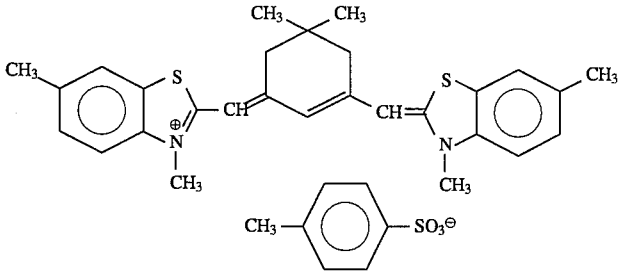

(These were added each in an amount of $5.0\times10^{-5}$ mol per mol of silver halide to the large-size emulsion and $8.0\times10^{-5}$ mol per mol of silver halide to the small-size emulsion.)

To the red-sensitive emulsion layer was added the following compound in an amount of $2.6\times10^{-3}$ mol per mol of silver halide.

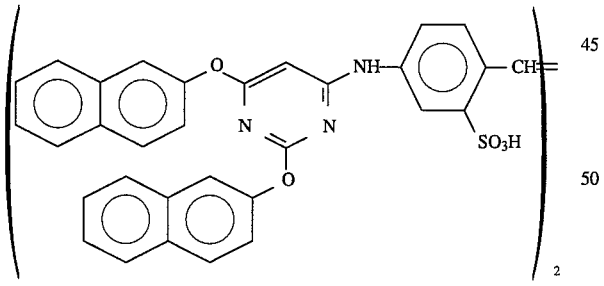

To each of the blue-sensitive emulsion layer, the green-sensitive emulsion layer and the red-sensitive emulsion layer was added Compound (2-2-6), which falls within the scope of the general formula (1) mentioned above, in an amount of $3.5\times10^{-4}$ mol, $3.0\times10^{-3}$ mol and $2.5\times10^{-4}$ mol, each per mol of silver halide, respectively.

To each of the blue-sensitive emulsion layer and the green-sensitive emulsion layer was added 4-hydroxy-6-methyl-1,3,3a,7-tetrazaindene in an amount of $1\times10^{-4}$ mol and $2\times10^{-4}$ mol, each per mol of silver halide, respectively.

For anti-irradiation, 10 mg/m$^2$ of Dye (III-42) mentioned above and the following dyes were added to the emulsion layers. The amounts of the dyes added are parenthesized.

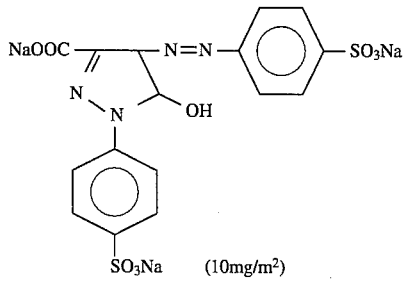

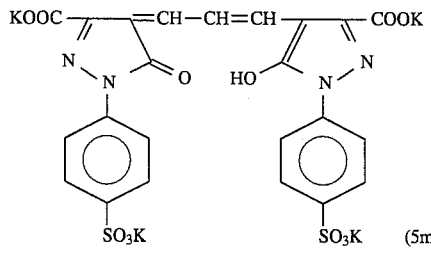

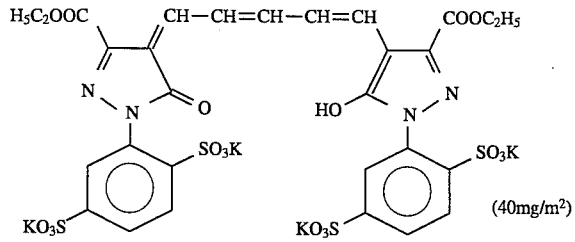

and

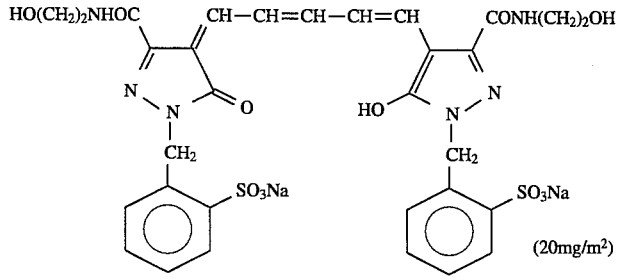

Layer Constitution of Photoqraphic Material Sample No. 104:

The composition of each layer of the photographic material sample prepared (sample No. 104) is mentioned below. The number indicates the amount of the component coated (g/m$^2$). The amount of the silver halide emulsion coated is represented by the amount of silver therein coated.

| | |
|---|---|
| Support: | |
| Polyethylene-laminated Paper A | |
| First Layer (Blue-sensitive Emulsion Layer): | |
| Above-mentioned Silver Chlorobromide Emulsion A | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-5) | 0.04 |
| Solvent (Solv-1) | 0.13 |
| Solvent (Solv-5) | 0.13 |
| Second Layer (Color Mixing Preventing Layer): | |
| Gelatin | 1.00 |

-continued

| | |
|---|---|
| Color Mixing Preventing Agent (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third Layer (Green-sensitive Emulsion Layer): | |
| Silver Chlorobromide Emulsion (1/3 (as silver molar ratio) mixture comprising a large-size emulsion B of cubic grains with a mean grain size of 0.55 μm and a small-size emulsion B of cubic grains with a mean grain size of 0.39 μm; the two emulsions each having a fluctuation coefficient of grain size distribution of 0.10 and 0.08, respectively, and each having 0.8 mol % of AgBr locally on the surfaces of the base grains composed of silver chloride) | 0.13 |
| Gelatin | 1.45 |
| Magenta Coupler (ExM) | 0.16 |
| Ultraviolet Absorbent (UV-2) | 0.16 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.08 |
| Color Image Stabilizer (Cpd-8) | 0.01 |

| | |
|---|---|
| Color Image Stabilizer (Cpd-10) | 0.02 |
| Solvent (Solv-3) | 0.13 |
| Solvent (Solv-4) | 0.39 |
| Solvent (Solv-6) | 0.26 |
| Fourth Layer (Color Mixing Preventing Layer): | |
| Gelatin | 0.70 |
| Color Mixing Preventing Agent (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth Layer (Red-sensitive Emulsion Layer): | |
| Silver Chlorobromide Emulsion (1/4 (as silver molar ratio) mixture comprising a large-size emulsion C of cubic grains with a mean grain size of 0.50 μm and a small-size emulsion C of cubic grains with a mean grain size of 0.41 μm; the two emulsions each having a fluctuation coefficient of grain size distribution of 0.09 and 0.11, respectively, and each having 0.8 mol % of AgBr locally on the surfaces of the base grains composed of silver chloride) | 0.20 |
| Gelatin | 0.85 |
| Cyan Coupler (ExC) | 0.33 |
| Ultraviolet Absorbent (UV-2) | 0.18 |
| Color Image Stabilizer (Cpd-1) | 0.33 |
| Color Image Stabilizer (Cpd-6) | 0.01 |
| Color Image Stabilizer (Cpd-8) | 0.01 |
| Color Image Stabilizer (Cpd-9) | 0.02 |
| Color Image Stabilizer (Cpd-10) | 0.01 |
| Solvent (Solv-1) | 0.01 |
| Solvent (Solv-7) | 0.22 |
| Sixth Layer (Ultraviolet Absorbing Layer): | |
| Gelatin | 0.60 |
| Ultraviolet Absorbent (UV-1) | 0.39 |
| Color Image Stabilizer (Cpd-5) | 0.01 |
| Color Image Stabilizer (Cpd-7) | 0.05 |
| Solvent (Solv-9) | 0.05 |
| Seventh Layer (Protective Layer): | |
| Gelatin | 1.00 |
| Acryl-modified Copolymer of Polyvinyl Alcohol (degree of modification: 17%) | 0.05 |
| Liquid Paraffin | 0.02 |
| Surfactant (Cpd-11) | 0.01 |

The compounds used above are mentioned below.

(ExY) Yellow Coupler:

1/1 (by mol) mixture of;

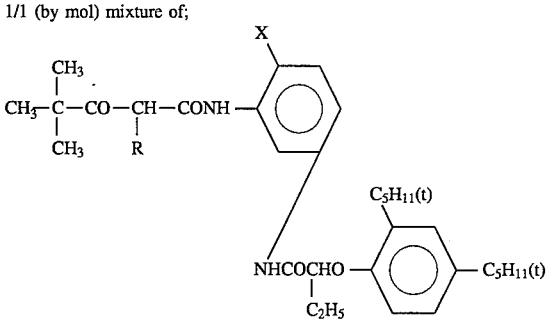

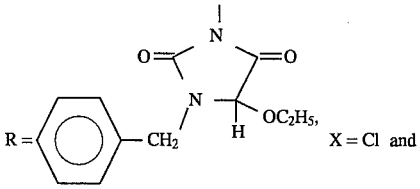

X = Cl and

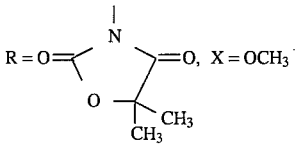

(ExM) Magenta Coupler:

1/1 (by mol) mixture of;

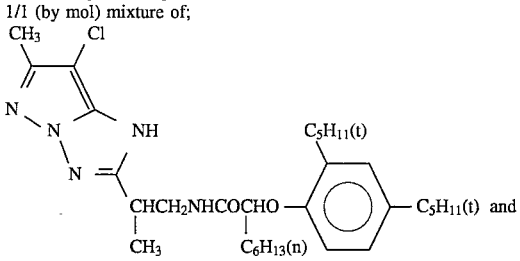

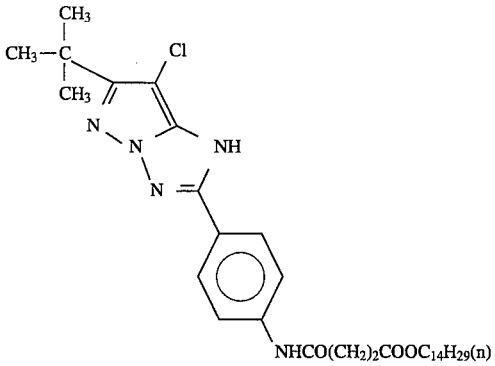

(ExC) Cyan Coupler:

25/75 (by mol) mixture of;

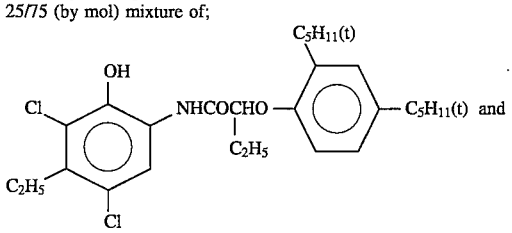

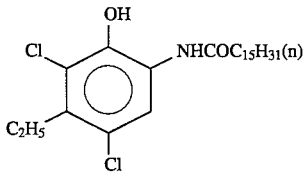

(Cpd-1) Color Image Stabilizer:

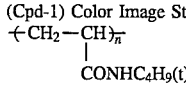

(number average molecular weight: 60,000)

(Cpd-2) Color Image Stabilizer:

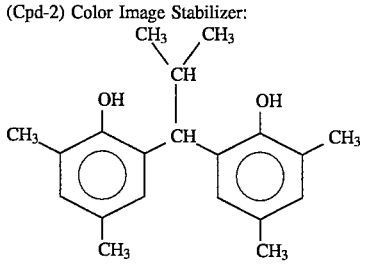

(Cpd-3) Color Image Stabilizer:

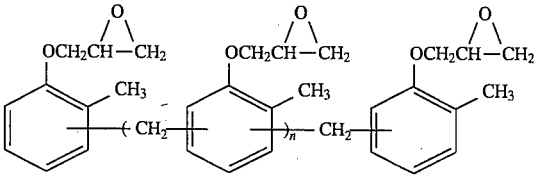

(n = 7 to 8, on average)

(Cpd-4) Color Mixing Preventing Agent:
1/1/1 (by weight) mixture of;

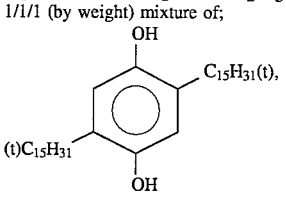

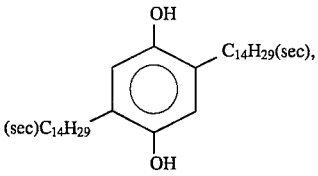

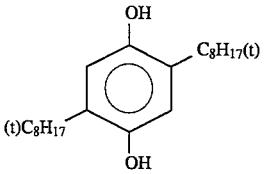

(Cpd-5) Color Image Stabilizer:

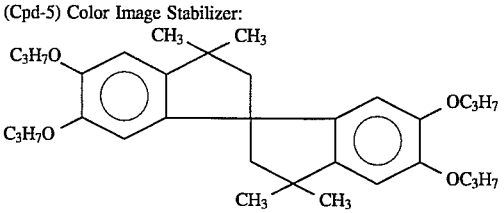

(Cpd-6) Color Image Stabilizer:

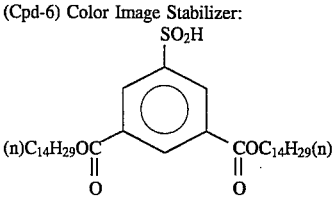

(Cpd-7) Color Image Stabilizer:

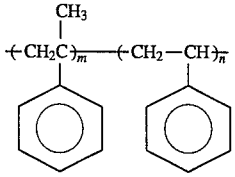

m/n = 9/1 (molar ratio)
(number average molecular weight: 600)

(Cpd-8) Color Image Stabilizer:

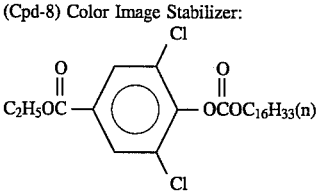

(Cpd-9) Color Image Stabilizer:

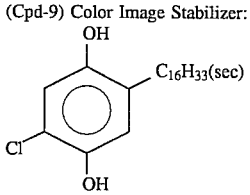

(Cpd-10) Color Image Stabilizer:

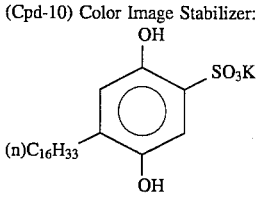

(Cpd-11) Surfactant:
2/1/1 (by weight) mixture of;

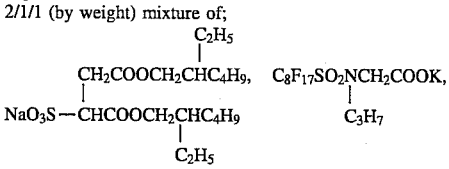

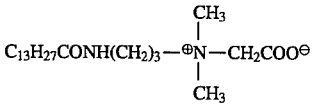

(Cpd-12) Antiseptic:

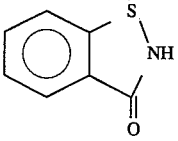

(Cpd-13) Antiseptic:

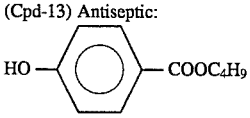

(UV-1) Ultraviolet Absorbent:
1/2/2/3/1 (by weight) mixture of;

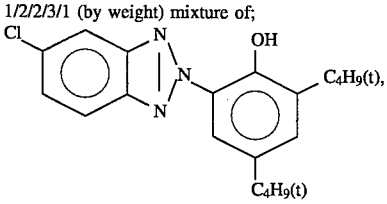

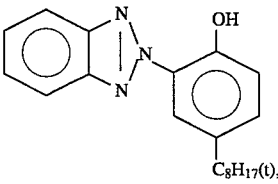

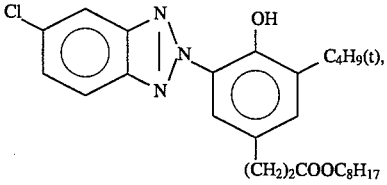

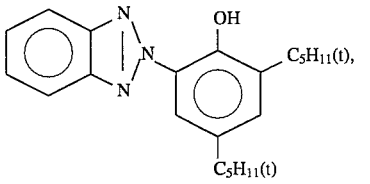

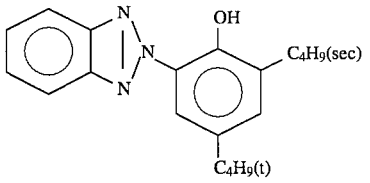

(UV-2) Ultraviolet Absorbent:
2/3/4/1 (by weight) mixture of;

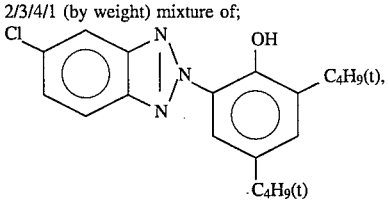

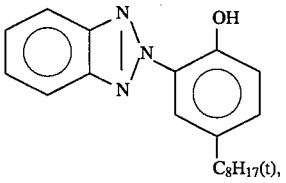

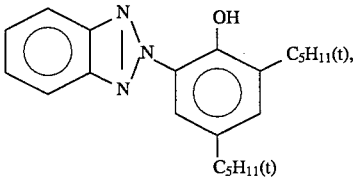

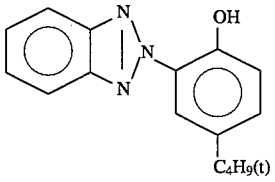

(Solv-1) Solvent:
$C_8H_{17}CH\underset{O}{\underset{\diagup\diagdown}{}}CH(CH_2)_7COOC_8H_{17}$ (Solv-2) Solvent:

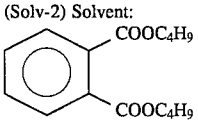

(Solv-3) Solvent:

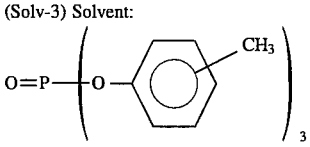

(Solv-4) Solvent:
$O{=}P{\leftarrow}O{-}C_6H_{13}(n))_3$ (Solv-5) Solvent:

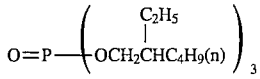

(Solv-6) Solvent:
$COOC_4H_9$
|
$(CH_2)_8$
|
$COOC_4H_9$ (Solv-7) Solvent:

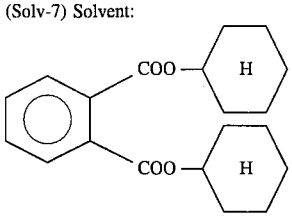

(Solv-8) Solvent:

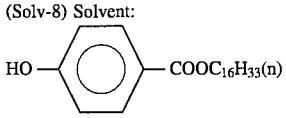

(Solv-9) Solvent:
$COOC_8H_{17}$
|
$(CH_2)_8$
|
$COOC_8H_{17}$

Samples Nos. 101 to 103 and samples Nos. 105 to 131 were prepared in the same manner as in preparation of Sample No. 104, except that the coating liquids and supports shown in Table 2 below were used.

TABLE 2

| Sample No. | Support | Compound of Formula (1) Kind | Compound of Formula (1) Amount Added (mol/mol of Ag) | Remarks |
|---|---|---|---|---|
| 101 | A | 2-2-6 | 0 | comparative sample |
| 102 | A | 2-2-6 | $0.9 \times 10^{-4}$ | comparative sample |
| 103 | A | 2-2-6 | $1.8 \times 10^{-4}$ | comparative sample |
| 104 | A | 2 2-6 | $3.5 \times 10^{-4}$ | comparative sample |
| 105 | B | 2-2-6 | $3.5 \times 10^{-4}$ | comparative sample |
| 106 | C | 2-2-6 | $3.5 \times 10^{-4}$ | comparative sample |
| 107 | D | 2-2-6 | 0 | comparative sample |
| 108 | D | 2-2-6 | $0.9 \times 10^{-4}$ | sample of the invention |
| 109 | D | 2-2-6 | $1.8 \times 10^{-4}$ | sample of the invention |
| 110 | D | 2-2-6 | $3.5 \times 10^{-4}$ | sample of the invention |
| 111 | D | 2-2-2 | $3.5 \times 10^{-4}$ | sample of the invention |
| 112 | D | 2-2-5 | $3.5 \times 10^{-4}$ | sample of the invention |
| 113 | D | 2-3-1 | $3.5 \times 10^{-4}$ | sample of the invention |
| 114 | D | 2-4-1 | $3.5 \times 10^{-4}$ | sample of the invention |
| 115 | E | 2-2-6 | $3.5 \times 10^{-4}$ | sample of the invention |
| 116 | F | 2-2-6 | $3.5 \times 10^{-4}$ | comparative sample |
| 117 | G | 2-2-6 | $3.5 \times 10^{-4}$ | sample of the invention |
| 118 | H | 2-2-6 | $3.5 \times 10^{-4}$ | sample of the invention |
| 119 | I | 2-2-6 | $3.5 \times 10^{-4}$ | sample of the invention |
| 120 | J | 2-2-6 | $3.5 \times 10^{-4}$ | comparative sample |
| 121 | K | 2-2-6 | $3.5 \times 10^{-4}$ | sample of the invention |
| 122 | L | 2-2-6 | $3.5 \times 10^{-4}$ | sample of the invention |
| 123 | M | 2-2-6 | $3.5 \times 10^{-4}$ | sample of the invention |
| 124 | N | 2-2-6 | $3.5 \times 10^{-4}$ | comparative sample |
| 125 | O | 2-2-6 | $3.5 \times 10^{-4}$ | comparative sample |
| 126 | P | 2-2-6 | $3.5 \times 10^{-4}$ | comparative sample |
| 127 | Q | 2-2-6 | $3.5 \times 10^{-4}$ | sample of the invention |
| 128 | R | 2-2-6 | $3.5 \times 10^{-4}$ | sample of the invention |

TABLE 2-continued

| Sample No. | Support | Compound of Formula (1) Kind | Amount Added (mol/mol of Ag) | Remarks |
|---|---|---|---|---|
| 129 | S | 2-2-6 | $3.5 \times 10^{-4}$ | sample of the invention |
| 130 | T | 2-2-6 | $3.5 \times 10^{-4}$ | comparative sample |
| 131 | U | 2-2-6 | $3.5 \times 10^{-4}$ | sample of the invention |

Sample No. 101 was formed into a roll film having a width of 127 nun. Using a printer processor (PP1820V Model; produced by Fuji Photo Film Co.), this was image-wise exposed and then continuously processed according to the process mentioned below until the amount of the replenisher to the color developer tank became 2 times the volume of the tank (for a running test).

Processing Steps:

| Step | Temp. | Time | Replenisher (ml)(*) |
|---|---|---|---|
| Color Development | 38.5° C. | 45 sec | 73 |
| Bleach-Fixation | 35° C. | 45 sec | 60(**) |
| Rinsing (1) | 35° C. | 30 sec | — |
| Rinsing (2) | 35° C. | 30 sec | — |
| Rinsing (3) | 35° C. | 30 sec | 360 |
| Drying | 80° C. | 60 sec | |

(*)This is the amount of the replenisher per $m^2$ of the sample being processed.
(**)In addition to this (60 ml), 120 ml per $m^2$ of the sample being processed were returned back from the rinsing bath (1).

Rinsing was effected by a three-tank countercurrent cascade system from the rinsing tank (3) to the rinsing tank (1).

The processing solutions used in the above-mentioned process are mentioned below.

| | Tank Solution | Replenisher |
|---|---|---|
| Color Developer: | | |
| Water | 800 ml | 800 ml |
| Ethylenediamine-tetraacetic Acid | 3.0 g | 3.0 g |
| Disodium 4,5-Dihydroxybenzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Brightening Agent (WHITEX 4B, product by Sumitomo Chemical Co.) | 1.0 g | 3.0 g |
| Sodium Sulfite | 0.1 g | 0.1 g |
| Disodium-N,N-bis(sulfonatoethyl)-hydroxylamine | 5.0 g | 10.0 g |
| Sodium Triisopropylnaphthalene-(β)sulfonate | 0.1 g | 0.1 g |
| N-ethyl-N-(β-methanesulfonamidoethyl)-3-methyl-4-animoaniline 3/2 Sulfate Monohydrate | 5.0 g | 11.5 g |
| Water to make | 1000 ml | 1000 ml |
| pH (adjusted with potassium hydroxide and sulfuric acid, 25° C.) | 10.00 | 11.00 |

-continued

| | Tank Solution | Replenisher |
|---|---|---|
| Bleach-fixing Solution: | | |
| Water | 600 ml | 150 ml |
| Ammonium Thiosulfate (750 g/liter) | 93 ml | 230 ml |
| Ammonium Sulfite | 40 g | 100 g |
| Ammonium Ethylenediaminetetraacetato/iron(III) | 55 g | 135 g |
| Ethylenediaminetetraacetic Acid | 5 g | 12.5 g |
| Nitric Acid (67%) | 30 g | 65 g |
| Water to make | 1000 ml | 1000 ml |
| pH (adjusted with acetic acid and aqueous ammonia, 25° C.) | 5.8 | 5.6 |
| Rinsing Solution: | | |
| Both the tank solution and the replenisher were the same. | | |
| Sodium Chloroisocyanurate | 0.02 g | |
| Deionized Water (having an electro-conductivity of 5 μs/cm or less) | 1000 ml | |
| pH | 6.5 | |

Evaluation of Emulsions-Coated Samples:

Using a sensitometer of FWH Model (produced by Fuji Photo Film Co.), each of samples Nos. 101 to 131 was exposed via a positive pattern print having rectangular waves with different densities at intervals of from 0.2 waves/mm to 60 waves/mm, where the difference in the density between the adjacent waves was 0.3. Next, the exposed samples were developed, using the above-mentioned automatic developing machine having the running solution prepared by the running test mentioned above.

The CTF (contrast transfer function) values of the thus-processed samples were measured, from which was obtained the spacial frequency for giving a magenta CTF of 0.8 in each sample. The larger the spacial frequency (/mm), the higher the sharpness of the sample.

In addition, these samples were subjected to a pressure resistance test. Briefly, each sample was put on the edge of a desk and folded at a right angle with the emulsions-coated surface facing inside. This was exposed to have a density of about 1.0 and then processed with the above-mentioned automatic developing machine having the running solution prepared as above. The difference in the yellow density (ΔD) at the folded part between the folded sample and the non-folded sample was obtained.

The exposure of the samples was effected, using a sensitometer of FWH Model (produced by Fuji Photo Film Co.); and the density of the processed samples was measured, using a densitometer of TCD Model (produced by Fuji Photo Film Co.).

Apart from these, the non-exposed samples were processed in the same manner as above, using the same automatic developing machine having the running solution prepared as above, and the yellow density (Dmin) of the processed samples was measured.

The results thus obtained are shown in Table 3 below.

TABLE 3

| Sample No. | Spacial Frequency (/mm) | Folding Resistance (ΔD) | Dmin | Remarks |
|---|---|---|---|---|
| 101 | 13 | ±0 | 0.25 | comparative sample |
| 102 | 13 | −0.22 | 0.10 | comparative sample |
| 103 | 13 | −0.31 | 0.07 | comparative sample |
| 104 | 13 | −0.45 | 0.07 | comparative sample |
| 105 | 14 | −0.05 | 0.07 | comparative sample |
| 106 | 7 | ±0 | 0.07 | comparative sample |
| 107 | 13 | +0.03 | 0.26 | comparative sample |
| 108 | 13 | ±0 | 0.09 | sample of the invention |
| 109 | 13 | ±0 | 0.08 | sample of the invention |
| 110 | 13 | ±0 | 0.08 | sample of the invention |
| 111 | 13 | ±0 | 0.08 | sample of the invention |
| 112 | 13 | ±0 | 0.08 | sample of the invention |
| 113 | 13 | ±0 | 0.09 | sample of the invention |
| 114 | 13 | ±0 | 0.09 | sample of the invention |
| 115 | 13 | ±0 | 0.09 | sample of the invention |
| 116 | 9 | ±0 | 0.08 | comparative sample |
| 117 | 13 | ±0 | 0.08 | sample of the invention |
| 118 | 14 | ±0 | 0.08 | sample of the invention |
| 119 | 15 | ±0 | 0.08 | sample of the invention |
| 120 | 15 | ±0 | 0.08 | comparative sample |
| 121 | 13 | ±0 | 0.08 | sample of the invention |
| 122 | 13 | ±0 | 0.08 | sample of the invention |
| 123 | 13 | ±0 | 0.08 | sample of the invention |
| 124 | 13 | ±0 | 0.08 | comparative sample |
| 125 | 5 | ±0 | 0.08 | comparative sample |
| 126 | 7 | ±0 | 0.08 | comparative sample |
| 127 | 12 | ±0 | 0.08 | sample of the invention |
| 128 | 12 | ±0 | 0.08 | sample of the invention |
| 129 | 15 | ±0 | 0.08 | sample of the invention |
| 130 | 15 | ±0 | 0.08 | comparative sample |
| 131 | 12 | ±0 | 0.07 | sample of the invention |

These samples were cut with a dull cutter, whereupon the roughness of the edges of the thus-cut pieces and the coloration of the edges of the developed pieces, if any, were checked.

As the cutter, used was a straw cutter produced by Konishiroku Co. Twenty of each sample were cut into pieces having a size of 12 cm×12 cm, and these pieces were developed with the above-mentioned automatic developing machine having the running solution prepared as above.

All these twenty samples thus processed were piled up and their edges were observed with the naked eye, by which the roughness and the coloration, if any, of the edges were checked.

The roughness of the edges was ranked by three ranks of "x", "Δ" and "○". "x" indicates that the edge was extremely rough so that, when it was rubbed by hand, wastes dropped from it. "Δ" indicates that the edge was rough. "○" indicates that the edge was seen smooth. The coloration of the edges of the developed pieces was ranked by three ranks of "x", "Δ" and "○". "x" indicates that the edge was wholly yellowed, while partly having reddish brown wastes. "Δ" indicates that the edge was lightly yellowed. "○" indicates that the edge was almost colorless. The results obtained are shown in Table 4 below.

TABLE 4

| Sample No. | Roughness of Edge | Coloration of Edge |
|---|---|---|
| 101 | X | X |
| 102 | X | X |
| 103 | X | X |
| 104 | X | X |
| 105 | X | X |
| 106 | ○ | ○ |
| 107 | ○ | X |

TABLE 4-continued

| Sample No. | Roughness of Edge | Coloration of Edge |
|---|---|---|
| 108 | ○ | Δ |
| 109 | ○ | ○ |
| 110 | ○ | ○ |
| 111 | ○ | ○ |
| 112 | ○ | ○ |
| 113 | ○ | ○ |
| 114 | ○ | ○ |
| 115 | ○ | ○ |
| 116 | ○ | ○ |
| 117 | ○ | ○ |
| 118 | ○ | ○ |
| 119 | ○ | Δ |
| 120 | X | X |
| 121 | ○ | ○ |
| 122 | ○ | ○ |
| 123 | ○ | ○ |
| 124 | ○ | ○ |
| 125 | ○ | ○ |
| 126 | ○ | ○ |
| 127 | ○ | ○ |
| 128 | ○ | ○ |
| 129 | Δ | ○ |
| 130 | X | X |
| 131 | ○ | ○ |

Samples Nos. 108 to 115, 117 to 119, 121 to 123, 127 to 129 and 131 of the present invention were good, as having high sharpness, high folding resistance and high whiteness (low Dmin).

Sample No. 101 not containing the compound of formula (1) was not good, as having an increased Dmin value and therefore having low whiteness, although its folding resistance was high.

Samples Nos. 106, 125 and 126 were not good, as having low sharpness.

Comparing samples Nos. 101 to 104 with each other, it is known that the samples not having the support of the present invention but containing the compound of formula (1) were not good as having low folding resistance, even though they had a lowered Dmin value.

Sample No. 107 having the support of the present invention but not containing the compound of formula (1) was not good, as having low whiteness (that is, having a high Dmin value).

Samples Nos. 101 to 105, 120 and 130 having any of supports A, B and T all falling outside the scope of the present invention were not good, as the edges of the pieces obtained by cutting them were extremely rough.

Samples Nos. 101 to 105, 107, 120 and 130 were also not good, as the coloration of the edges of the pieces obtained by cutting them was great after development.

Sample No. 124 was not good, as having many large streaky depressions on its surface.

As has been described in detail hereinabove, the present invention provides a silver halide color photographic material which can be processed rapidly to form a color image having high sharpness while having high whiteness in the background area. The material has high folding resistance, and the density of the image at the folded part is not lowered. Even when the material is cut with a dull cutter, the edges of the resulting pieces are not rough. The edges of the pieces are not colored by development.

EXAMPLE 2

The same procedure as in Sample No. 110 in Example 1 was followed, except for using an equivalent amount of compounds shown in Table 5 instead of magenta coupler ExM (mixture) used in the third layer. The Samples thus obtained are designated Sample Nos. 201 to 210.

TABLE 5

| Sample No. | Coupler |
|---|---|
| 201 | M-4 |
| 202 | M-6 |
| 203 | M-14 |
| 204 | M-18 |
| 205 | M-34 |
| 206 | M-35 |
| 207 | M-37 |
| 208 | M-41 |
| 209 | MM-1 |
| 210 | MM-2 |

Comparative Coupler

MM-1

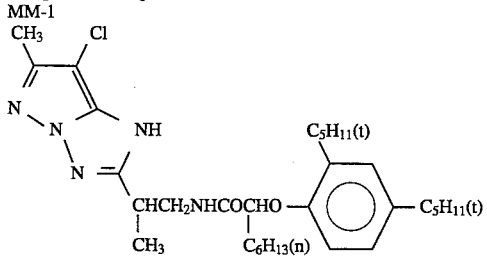

MM-2

TABLE 5-continued

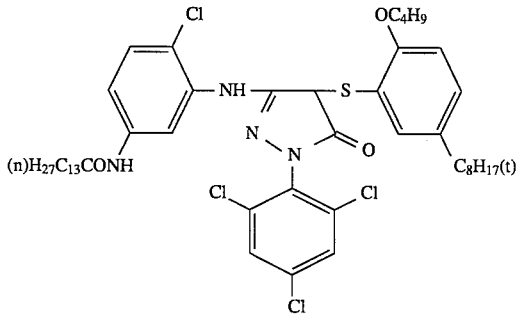

In the same way as in Example 1, the samples were cut with a dull cutter, whereupon the roughness of the edges of the cutt pieces and the coloration of the edges of the developed pieces were checked.

The results thus obtained are shown in the following Table 6.

TABLE 6

| Sample No. | Roughness of Edge | Coloration of Edge | Remarks |
|---|---|---|---|
| 201 | ○ | ○ | Invention |
| 202 | ○ | ○ | Invention |
| 203 | ○ | ○ | Invention |
| 204 | ○ | ○ | Invention |
| 205 | ○ | ○ | Invention |
| 206 | ○ | ○ | Invention |
| 207 | ○ | ○ | Invention |
| 208 | ○ | ○ | Invention |
| 209 | ○ | Δ | Comparison |
| 210 | ○ | X | Comparison |

As is apparent from the above results, Sample Nos. 201 to 208 do not show the coloration of the edges of the developed pieces, which is preferred.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having, on a reflective support composed of a substrate coated with waterproof resin layers, photographic constitutive layers comprising at least a silver halide emulsion layer containing cyan dye-forming coupler(s), a silver halide emulsion layer containing magenta dye-forming coupler(s), a silver halide emulsion layer containing yellow dye-forming coupler(s) and plural non-light-sensitive colloidal layers, which is characterized in that the number of said waterproof resin layers between said photographic constitutive layers and said substrate is at least three, at least one of said waterproof resin layers contains from 15% by weight to 45% by weight of a white pigment, the waterproof resin layer nearest to the substrate and that nearest to the photographic constitutive layers do not contain a white pigment or contain it in an amount of 20% by weight or less, the thickness of the waterproof resin layer nearest to the photographic constitutive layers is 5 μm or less, at least one silver halide emulsion to be in at least one of said silver halide emulsion layers contains high silver chloride emulsion grains having a silver chloride content of 95 mol % or more, and the layer containing said high silver chloride emulsion contains a compound of a general formula (1):

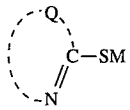

(1)

wherein Q represents an atomic group necessary for forming a 5-membered or 6-membered hetero ring or a 5-membered or 6-membered hetero ring condensed with benzene ring(s); and M represents a cation.

2. The silver halide color photographic material as claimed in claim 1, wherein at least one of said three or more waterproof resin layers on the support under the photographic constitutive layers contains a colorant wherein the waterproof resin layer closer to the substrate of the support than the waterproof resin layer having the highest content of white pigment has the highest content of colorant.

3. The silver halide color photographic material as claimed in claim 1, wherein any of the photographic constitutive layers coated on the support contains a water-soluble dye of a general formula (2):

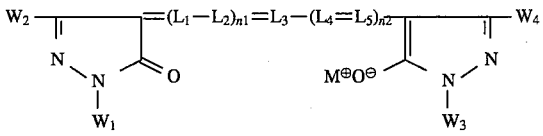

(2)

wherein $W_1$ and $W_3$ each represent an aliphatic group, an aromatic group or a heterocyclic group;

$W_2$ and $W_4$ each represent an aliphatic group, an aromatic group, $—OW_5$, $—COOW_5$, $—NW_5W_6$, $—CONW_5W_6$, $—NW_5CONW_5W_6$, $—SO_2W_7$, $—COW_7$, $—NW_6COW_7$, $—NW_6SO_2W_7$, or a cyano group; in which $W_5$ and $W_6$ each represent a hydrogen atom, an aliphatic group or an aromatic group; $W_7$ represents a hydrogen atom or an aliphatic group; $W_5$ and $W_6$, or $W_6$ and $W_7$ may be bonded to each other to form a 5-membered or 6-membered ring;

$L_1$, $L_2$, $L_3$, $L_4$ and $L_5$ each represent a methine group;

$n_1$ and $n_2$ each represent 0 or 1; and $M^+$ represents a hydrogen atom or a monovalent cation.

4. The silver halide color photographic material as claimed in claim 1, wherein the compound of formula (1) is a mercapto compound of a general formula (1-1), (1-2), (1-3) or (1-4):

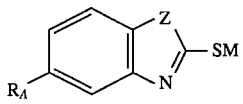

(1-1)

wherein $R_A$ represents a hydrogen atom, an alkyl group, an alkoxy group, an aryl group, a halogen atom, a carboxyl group or its salt, a sulfo group or its salt, or an amino group;

Z represents —NH—, —O—, or —S—;

M has the same meaning as that in formula (1)

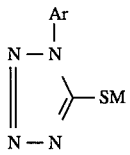

(1-2)

wherein Ar represents

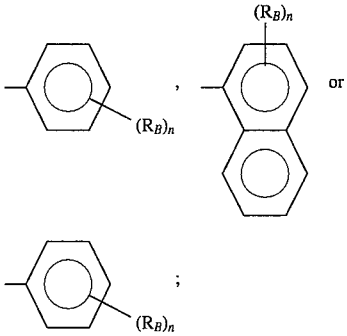

$R_B$ represents an alkyl group, an alkoxy group, a carboxyl group or its salt, a sulfo group or its salt, a hydroxyl group, an amino group, an acylamino group, a carbamoyl group, or a sulfonamido group;

n represents an integer of from 0 to 2;

M has the same meaning as that in formula (1)

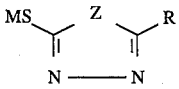

(1-3)

wherein Z represents $—N(R_{A1})—$, an oxygen atom or a sulfur atom;

R represents a hydrogen atom, an alkyl group, an aryl group, an alkenyl group, a cycloalkyl group, $—SR_{A1}$, $—N(R_{A2})R_{A3}$, $—NHCOR_{A4}$, $—NHSO_2R_{A5}$, or a heterocyclic group;

$R_{A1}$ represents a hydrogen atom, an alkyl group, an alkenyl group, a cycloalkyl group, an aryl group, $—COR_{A4}$, or $—SO_2R_{A5}$;

$R_{A2}$ and $R_{A3}$ each represent a hydrogen atom, an alkyl group, or an aryl group;

$R_{A4}$ and $R_{A5}$ each represents an alkyl group or an aryl group;

M has the same meaning as that in formula (1)

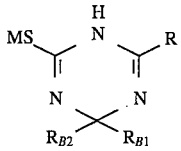

(1-4)

wherein R and M have the same meanings as those in formula (1-3);

$R_{B1}$ and $R_{B2}$ have the same meanings as $R_{A1}$ and $R_{A2}$, respectively, in formula (1-3).

5. The silver halide color photographic material as claimed in claim 1, wherein at least one of the magenta dye-forming coupler(s) is a compound represented by the following formula (M-1):

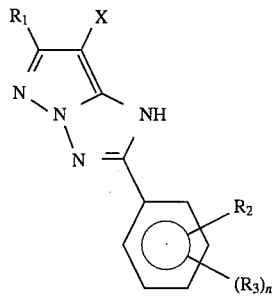

(M-1)

wherein $R_1$ represents a group represented by the following formula (Q-1), (Q-2) or (Q-3); $R_2$ and $R_3$ each represent a substitutent; n represents an integer of 0 to 4; X represents a hydrogen atom, or a group capable of being released by a coupling reaction with an oxidation product of a developing agent:

$$—C(R_4)(R_5)—(R_6) \quad (Q\text{-}1)$$

wherein, $R_4$ represents an alkyl group, a cycloalkyl group, an aryl group or a heterocyclic group, $R_5$ and $R_6$ each represent a substituent, and at least two of $R_4$, $R_5$ and $R_6$ may be connected to form a 5- to 7-membered monocyclic or condensed ring;

$$—CH(R_7)—(R_8) \quad (Q\text{-}2)$$

wherein, $R_7$ represents an alkyl group, a cycloalkyl group, an aryl group or a heterocyclic group, $R_8$ represents a substituent, and $R_7$ and $R_8$ may be connected to form a 5- to 7-membered monocyclic or condensed ring;

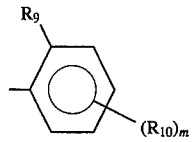

(Q-3)

wherein, $R_9$ and $R_{10}$ each represent a substituent, m represents an integer of 0 to 4, and when m is 2 or more, two or more of $R_{10}$ may be the same or different.

6. The silver halide color photographic material as claimed in claim 1, wherein a waterproof resin composing the waterproof resin layer is polyolefin.

7. The silver halide color photographic material as claimed in claim 1, wherein said white pigment is an inorganic pigment selected from the group consisting of titanium dioxide, barium sulfate, lithophone, aluminum oxide, calcium carbonate, silicon oxide, antimonytrioxide, titanium phosphate, zinc oxide, white lead, zirconium oxide, and an organic fine powder, wherein the organic fine powder is selected from the group consisting of a polystyrene and a styrene-divinylbenzene copolymer.

8. The silver halide color photographic material as claimed in claim 1, wherein said white pigment is used in a total amount of 1 $g/m^2$ to 15 $g/m^2$.

9. The silver halide color photographic material as claimed in claim 1, wherein said photographic material prior to development has an optical reflective density of 0.2 or more at a wavelength of 550 nm, of 0.3 or more at a wavelength of 680 nm, and of 0.2 to 2.0 at a wavelength of 480 nm.

10. The silver halide color photographic material as claimed in claim 1, wherein the amount of said compound of formula (1) is from $1\times10^{-5}$ to $5\times10^{-2}$ mol per mol of the silver halide in the material.

11. The silver halide color photographic material as claimed in claim 3, wherein the total amount of said water soluble dye of formula (2) is from 1 $mg/m^2$ to 500 $mg/m^2$.

12. The silver halide color photographic material as claimed in claim 1, said high silver chloride emulsion grains are those having layered or non-layered, localized phases of silver bromide in the inside and/or on the surface of the silver halide grains.

* * * * *